US007303521B2

(12) United States Patent
Fujinuma et al.

(10) Patent No.: US 7,303,521 B2
(45) Date of Patent: Dec. 4, 2007

(54) FOLDING APPARATUS OF ROTARY PRESS

(75) Inventors: Hiroyuki Fujinuma, Kunitachi (JP); Toshio Hasegawa, Kawasaki (JP); Yukitoshi Takahashi, Kawasaki (JP)

(73) Assignee: Kabushikikaisha Tokyo Kikai Seisakusho, Tokyo (JP)

( * ) Notice: Subject to any disclaimer, the term of this patent is extended or adjusted under 35 U.S.C. 154(b) by 751 days.

(21) Appl. No.: 10/740,507

(22) Filed: Dec. 22, 2003

(65) Prior Publication Data

US 2004/0221749 A1 Nov. 11, 2004

(30) Foreign Application Priority Data

May 8, 2003 (JP) ..... 2003-130905

(51) Int. Cl.
*B31F 1/08* (2006.01)

(52) U.S. Cl. ..... 493/428; 493/432; 493/424

(58) Field of Classification Search ..... 493/428, 493/432, 424, 427, 429, 437, 340
See application file for complete search history.

(56) References Cited

U.S. PATENT DOCUMENTS 4,380,449 A * 4/1983 Michalik ..... 493/424
5,201,701 A * 4/1993 Roettger et al. ..... 493/425
6,487,965 B2 * 12/2002 Stieler et al. ..... 101/216
6,846,279 B2 * 1/2005 Stieler et al. ..... 493/424
6,895,858 B2 * 5/2005 Kostiza et al. ..... 101/219
7,083,561 B2 * 8/2006 Prum ..... 493/424

FOREIGN PATENT DOCUMENTS

| | | |
|---|---|---|
| JP | 43-6191 | 3/1968 |
| JP | 61254468 | 11/1986 |
| JP | 63-18577 | 8/1988 |
| JP | 63-185777 | 8/1988 |
| JP | 7-157193 | 6/1995 |
| JP | 3117256 B | 10/2000 |
| JP | 2001-26374 | 1/2001 |

* cited by examiner

*Primary Examiner*—Sameh H. Tawfik
(74) *Attorney, Agent, or Firm*—Morgan, Lewis & Bockius LLP

(57) ABSTRACT

A folding apparatus of a rotary press which can select collect run or straight run comprises: a fixed pin cam 2 which performs operations of straight run and collect run; a correction pin cam 3 which stops in case of straight run, and protrudes/retracts a pin end portion with respect to an outer periphery of a folding cylinder once per two rotations of a folding cylinder 12 in case of collect run; a blade cam 4 which thrusts a blade of each blade device 16 into a jaw device 17 once per rotation of the folding cylinder in case of straight run, and thrusts the same into the jaw device 17 once per two rotations of the folding cylinder in case of collect run; switching means 62 for switching between a drive side connection and a stop side connection of the correction pin cam and the blade cam; and detecting means 61 for detecting a start-up timing of the switching means.

19 Claims, 13 Drawing Sheets

| ROTATION ANGLE: BLADE CAM | ROTATION ANGLE: CORRECTION PIN CAM | FOLDING CYLINDER ROTATION ANGLE | CUTTING CYLINDER ROTATION ANGLE |
|---|---|---|---|
| REFERENCE POSITION | | | |
| 45° | | 60° | 90° |
| 90° | | 120° | 180° |
| 135° | | 180° | 270° |
| 180° | | 240° | 360° |

STRAIGHT RUN

| BLADE CAM | CORRECTION PIN CAM | FOLDING CYLINDER ROTATION ANGLE | CUTTING CYLINDER ROTATION ANGLE |
|---|---|---|---|
| ROTATION ANGLE | | | |
| REFERENCE POSITION | | | |
| 45° | | 60° | 90° |
| 90° | | 120° | 180° |
| 135° | | 180° | 270° |
| 180° | | 240° | 360° |

COLLECT RUN

FOLDING APPARATUS OF ROTARY PRESS

BACKGROUND OF THE INVENTION

1. Field of the Invention

The present invention relates to a folding apparatus of a rotary press which cuts a printed paper web and is capable of performing a collect run by which cut print paper sheets are superposed and folded and a straight run by which they are folded without being superposed.

2. Description of the Prior Art

Conventionally, in a folding apparatus of a rotary press which includes a cutting cylinder, a folding cylinder and a jaw cylinder and is capable of performing collect run that print paper sheets are wound around the folding cylinder and superposed and straight run that the print paper sheets are folded without being superposed, the collect run and the straight run are switched in accordance with an operation conformation of the collect run or the straight run, e.g., a change in respective operation timings of a pin device and a blade device of the folding cylinder. Further, various improvements have been carried out in order to make it easier to facilitate a switching operation of these devices. Techniques to switch between the collect run and the straight run are disclosed in some patent references (see e.g., Japanese patent application laid-open No. 254468/1986, Japanese patent application laid-open No. 185777/1988 and Japanese patent publication No. 3117256).

A technique disclosed in Japanese patent application laid-open No. 254468/1986 is a technique concerning only an operation conformation of a pin device included in a folding cylinder. However, in a folding apparatus of a rotary press capable of switching between the collect run and the straight run, there is adopted a structure that a pin which is pushed through a leading end side of a print paper sheet provided to a folding cylinder is protruded/retracted from a circumferential surface of the folding cylinder by a pin operation cam (which will be referred to as a pin cam hereinafter). The pin cam is a so-called two-ply pin cam obtained by dividing the pin cam and laminating the divided cams. A plurality of irregularities are provided to each cam, and the number of cam irregularities is changed by varying an attachment position of the two-ply cam with the folding device being paused, thereby changing an operation timing of the pin.

Specifically, the pin device and the blade device are alternately arranged so as to form a phase angle of approximately 60 degrees on a circumference of the folding cylinder having a circumferential length threefold of a cut length of the print paper sheet (which will be referred to as a length of the print paper sheet hereinafter) which is a so-called threefold cylinder, a gear x which is meshed with a folding cylinder gear is provided on one end side of a shaft disposed in parallel with the folding cylinder, and the two-ply cam is integrally provided in the adjacent manner to a gear z which is meshed with a gear y fixed on the other end side of the shaft and rotates around a shaft center on the other end side of the folding cylinder, thereby enabling the rotary driving. The two-ply cam fixed to the gear z can change an attachment phase of the two pin cams in accordance with the collect run or the straight run. It is to be noted that jaw devices can be attached at two positions of a jaw cylinder provided so as to be opposed to the folding cylinder, and a holding plate is operated by a holding cam.

A technique disclosed in Japanese patent application laid-open No. 185777/1988 is a technique concerning only an operation conformation of a blade device included in a folding cylinder. There are provided a thrust blade operation cam (which will be referred to as a blade cam hereinafter) rotatably supported by the folding cylinder, force transmitting means for transmitting a turning force to the blade cam and switching means for allowing or cutting transmission of force between the force transmitting means and the blade cam, thereby enabling switching between the collect run and the straight run without attaching/detaching a holding plate.

Specifically, a cutting cylinder has a circumferential length twofold of a length of the cut print paper sheet, whereas the folding cylinder is set to have a threefold circumferential length. A blade gear having the blade cam integrally attached thereto is rotatably supported by a shaft portion of the folding cylinder. Further, a shaft (which will be referred to as a clutch shaft hereinafter) is provided parallel with the folding cylinder, and a clutch member which can move in an axial direction and which is coupled in a rotating direction is provided to this clutch shaft. A gear which has a connection portion, which can be connected with the clutch member and which is capable of rotating is provided to the clutch shaft, and this gear is meshed with the gear fixed to the shaft end portion of the folding cylinder. Furthermore, a gear which is meshed with the blade gear is provided on the end side of the clutch shaft, and the blade cam can go into a 360-degree roll while the folding cylinder makes a ⅔ rotation when the blade cam is driven by this gear. A fixed fixation member is provided on the frame side, and the fixation member has a connection portion which can be connected with the clutch member at an end portion thereof. The clutch member has a neutral position at which it is connected with neither the connection portion of the gear nor the connection portion of the fixation member. In this neutral position, the clutch shaft can be turned from the outside by a handle when the folding cylinder is stopped, and a phase of the blade cam with respect to the folding cylinder can be adjusted so as to be associated with the collect run or the straight run. That is, when switching to the collect run or the straight run, the folding device is stopped, the clutch shaft is turned at the neutral position by a handle, a phase of the blade cam relative to the folding cylinder is adjusted, and thereafter connection is established. In case of the collect run, the clutch member is moved to the gear side and connected, switching is performed so as to enable rotation of the blade cam with the clutch shaft being capable of turning. In case of the straight run, the clutch member is moved to the fixation member side and connected, and switching is performed so as not to rotate the blade cam with the clutch shaft being prevented from turning.

A technique disclosed in Japanese patent publication No. 3117256 is a technique concerning only an operation conformation of a pin device and a blade device included in a folding cylinder. There are provided: a first rotary cam (rotary pin cam) which is disposed to a frame which is provided on one end side of a folding cylinder and rotatably supports the folding cylinder independently from the folding cylinder, and has a concave portion which carries out an operation of the straight run; a first fixed cam (fixed pin cam) which is adjacent to the rotary cam, and fixed and provided to the frame; a second rotary cam (rotary blade cam) which is disposed to a frame which is provided on the other end side of the folding cylinder and rotatably supports the folding cylinder independently from the folding cylinder, and has a concave portion which carries out an operation of the straight run; and a second fixed cam (fixed blade cam) which is adjacent to the second rotary cam, and fixed and provided to the frame, and this technique further includes a two-point clutch which matches or releases two sets of two-ply cams each consisting of the rotary cam and the fixed cam at any timing of the collecting folding or the straight run. The two-point clutch is provided on a shaft of a cam drive system which drives the two rotary cams, changes a meshing position of the clutch in accordance with a predetermined timing without replacing the cams, and switches between the collect run and the straight run.

The technique disclosed in Japanese patent application laid-open No. 254468/1986 has the following problems to be solved. That is, when switching the operation timing of the pin in case of the collect run or the straight run, it must forcibly perform a troublesome skilled operation that the folding device is stopped, then fixation of the two-ply pin cam integrated with the gear is released, and a phase of the pin cams must be changed in accordance with a pin operation timing of the folding cylinder each time. Additionally, in the folding apparatus, in order to completely perform switching between the collect run and the straight run, the blade device must also perform the switching operation, resulting in a very complicated switching operation.

Further, the technique disclosed in Japanese patent application laid-open No. 185777/1988 has the following problems to be solved. That is, when switching an operation timing of the blade to the collect run or the straight run, it must perform a very troublesome skilled operation that the folding apparatus is stopped, then the clutch member meshed with one gear is manually moved for uncoupling and set at the neutral position, a phase of the blade cam is adjusted with respect to the folding cylinder by turning the clutch shaft by using a handle and thereafter the clutch member is further moved to be meshed with the other gear. Furthermore, in the folding apparatus, in order to completely perform switching between the collect run and the straight run, the operation timing of the pin of the pin device must be individually carried out, resulting in a very complicated switching operation.

Moreover, the technique disclosed in Japanese patent publication No. 3117256 has the following problems to be solved. That is, when switching the operation timing of the pin and the blade to any one of the collect run and the straight run, it must carry out a very troublesome skilled operation that the folding apparatus is stopped, then the two-point clutch provided on the shaft of the cam drive system is moved in the axial direction to cancel the meshed state, the rotary cam is displaced with respect to the fixed cam by turning the shaft until a predetermined timing relationship is obtained, and the two-point clutch is again moved at that position in the axial direction opposite to the former direction for meshing. Additionally, the two-ply cam is provided on each of both sides of the folding cylinder, the shaft driving this is stretched from one frame to the other frame, and hence the structure is very complicated.

SUMMARY OF THE INVENTION

It is an object of the present invention to provide a folding apparatus of a rotary press, which can perform switching between collect run and straight run in a simple structure without performing a complicated operation.

The present invention is intended to solve the problems of the prior arts altogether by a structure described in claims.

That is, a folding apparatus of a rotary press includes a cutting cylinder having at least one cutting blade device, a folding cylinder having at least one pin device and the same number of blade device as that of the pin device, and a jaw cylinder having a jaw device, which can cut a printed paper web and perform collect run that print paper sheets are wound around the folding cylinder, superposed and folded and straight run that the print paper sheets are folded without being superposed, and which can switch to either run type and discharge the collect-folded or straight-folded print paper sheets.

The folding apparatus of a rotary press comprising:

a fixed pin cam which is fixed to a frame side, and can protrude/retract an end of a pin of each pin device with respect to an outer periphery of the folding cylinder once per rotation of the folding cylinder so as to perform a straight run operation;

a correction pin cam which is provided so as to be adjacent to the fixed pin cam in such a manner that it can rotate around a shaft center of the folding cylinder with a number of revolutions different from that of the folding cylinder, can stop so as not to obstruct an operation of the pin which is protruded/retracted by the fixed pin cam in case of straight run, and can protrude/retract an end portion of a pin of each pin device with respect to the outer periphery of the folding cylinder once per two rotations of the folding cylinder so as to perform a collect run operation by an interaction with the fixed pin cam in case of collect run;

a blade cam which is provided so as to be adjacent to the correction pin cam in such a manner that it can rotate around the shaft center of the folding cylinder integrally with the correction pin cam and it can operate a blade of the blade device correlatively with an operation of the pin at a position opposed to the jaw device, which can stop together with the correction pin and thrust the blade of each blade device with respect to the jaw device once per rotation of the folding cylinder so as to perform a straight run operation in case of straight run, and which can rotate together with the correction pin cam and thrust the blade of each blade device with respect to the jaw device once per two rotations of the folding cylinder so as to perform a collect run operation in case of collect run; and a switching device consisting of: switching means provided in a force transmission path through which rotary driving is transmitted to the correction pin cam and the blade cam all at once so as to be capable of switching between a drive side connection that connection with a drive side is established and the two cams are driven to rotate and stop side connection that connection with the drive side is released and the two cams are stopped with a preset rotary phase, and capable of instantaneously establishing both the drive side connection and the stop side connection at the time of switching; detecting means for detecting a start-up timing of the switching means on the basis of a rotation of a drive source with either collect run or straight run being specified, wherein collect run or straight run is selectively switched while operating the folding apparatus.

In switching of collect run and straight run of the folding apparatus, when the folding apparatus is operated at a low speed and the cutting cylinder, the folding cylinder and the jaw cylinder are rotated at a preset speed, the correction pin cam and the blade cam which can integrally rotate with respect to the fixed pin cam are rotated in case of collect run, while they are stopped in case of straight run, and both the drive side connection and the stop side connection can be instantaneously attained at the time of switching of the switching means. As a result, collect run or straight run is automatically and assuredly switched.

Further, according to the folding apparatus of a rotary press of the present invention, the switching means comprises:

an intermediate shaft rotatably provided parallel with a shaft center of the cutting cylinder;

a driven gear which is meshed with a gear provided to the cutting cylinder on the drive side, rotatably provided with respect to the intermediate shaft and has a concave portion on a side surface;

an intermediate shaft gear which is fixed to the other end of the intermediate gear and meshed with a relay gear relative to the correction pin cam and the blade cam on the driven side;

a fixing member which is arranged between the intermediate shaft gear and the driven gear, and has a concave portion opposed to the concave portion of the driven gear a and a hole through which the intermediate shaft is inserted;

a clutch member which is provided between the driven gear and the fixing member, capable of moving in the axial direction of the intermediate shaft and rotating integrally with the intermediate shaft in the rotating direction, and has a convex portion provided on each of both end surfaces in the axial direction, convex portion of which can be fitted to the concave portion of the drive gear or of the fixing member opposed to the end surface, a dimension from a tip of the convex portion on one end surface to a tip of the convex portion on the other end surface being slightly larger than a distance between opposed end surfaces of the driven gear and the fixing member; and a movement mechanism which selectively moves the clutch member in one way of the axial direction of the intermediate shaft.

The dimension of the clutch member from the tip of the convex portion on one end surface to the tip of the convex portion on the other end surface is slightly larger than the distance between the opposed end surfaces of the driven gear and the fixing member, and there is a range that the convex portions provided on the both end portions of the clutch member of the switching means can be fitted in both of the opposed convex portions in a very short time during movement of the clutch member in the axial direction, thereby automatically and assuredly performing switching. Therefore, in switching between collect run and straight run in the folding apparatus, switching can be very easily achieved without requiring skills at all, a troublesome switching operation is no longer necessary, a working efficiency at the time of switching can be enhanced, and an operating efficiency of the rotary press can be improved.

Furthermore, in the folding apparatus of a rotary press it is preferable that the clutch member can rotate integrally with the intermediate shaft by a key and can move with respect to the intermediate shaft in the axial direction.

As a result, the clutch member can integrally rotate while being capable of moving with respect to the intermediate shaft in the axial direction.

Moreover, in the folding apparatus of a rotary press it is preferable that the convex portions on the both end surface of the clutch member in the axial direction are provided in a straight line form in a direction perpendicularly cutting across the shaft center of the intermediate shaft in phase and they can be fitted in and connected with the concave portion of the driven gear or the fixing member when movement of the clutch member on the intermediate shaft in the axial direction is completed.

As a result, the clutch member can be assuredly connected with the driven gear or the fixing member through each convex portion.

Additionally, in the folding apparatus of a rotary press it is preferable that the clutch member can also be connected with the fixing member at another position obtained by rotating the disconnected clutch member 180 degrees from one connection position.

As a result, the clutch member can be rapidly connected with the fixing member.

Further, in the folding apparatus of a rotary press it is preferable that the clutch member has a groove at an outer peripheral portion and is connected with the movement mechanism through this groove.

Consequently, engagement between the clutch member and the movement mechanism can be assuredly attained.

Furthermore, in the folding apparatus of a rotary press it is preferable that the movement mechanism includes a shift lever which has a guide roller inserted into the groove at one end and fixed to a rotatable shaft, an operation lever which is fixed to the shaft, and a pneumatic cylinder connected to the other end of the operation lever.

As a result, the movement mechanism can smoothly operate the clutch member.

Moreover, in the folding apparatus of a rotary press it is preferable that a cylinder rod of the pneumatic cylinder is connected to the other end of the operation lever, the shift lever is subjected to angular displacement by expansion or contraction of the cylinder rod of the pneumatic cylinder, and the clutch member can move in the axial direction of the intermediate shaft.

As a result, the movement mechanism can further smoothly operate the clutch member.

Additionally, in the folding apparatus of a rotary press it is preferable that the intermediate shaft rotates and enters a drive side connection state in which a force can be transmitted when one convex portion of the clutch member is connected with the concave portion of the driven gear, and the intermediate shaft is stopped and enters a stop side connection state when the other convex portion of the clutch member is connected with the concave portion of the fixing member.

As a result, the clutch member can be smoothly operated from the drive side connection state and the stop side connection state.

Further, in the folding apparatus of a rotary press it is preferable that the detecting means consists of a detection piece provided at a cutting cylinder shaft of the cutting cylinder and a detector which detects the detection piece.

Consequently, a start-up timing of the switching means for switching between collect run and straight run can be assuredly obtained.

BRIEF DESCRIPTION OF THE DRAWINGS

The foregoing and other features of the present invention will become apparent to those skilled in the art to which the present invention relates from reading the following description with reference to the accompanying drawings, in which.

DETAILED DESCRIPTION OF THE PREFERRED EMBODIMENT

Figure 5:
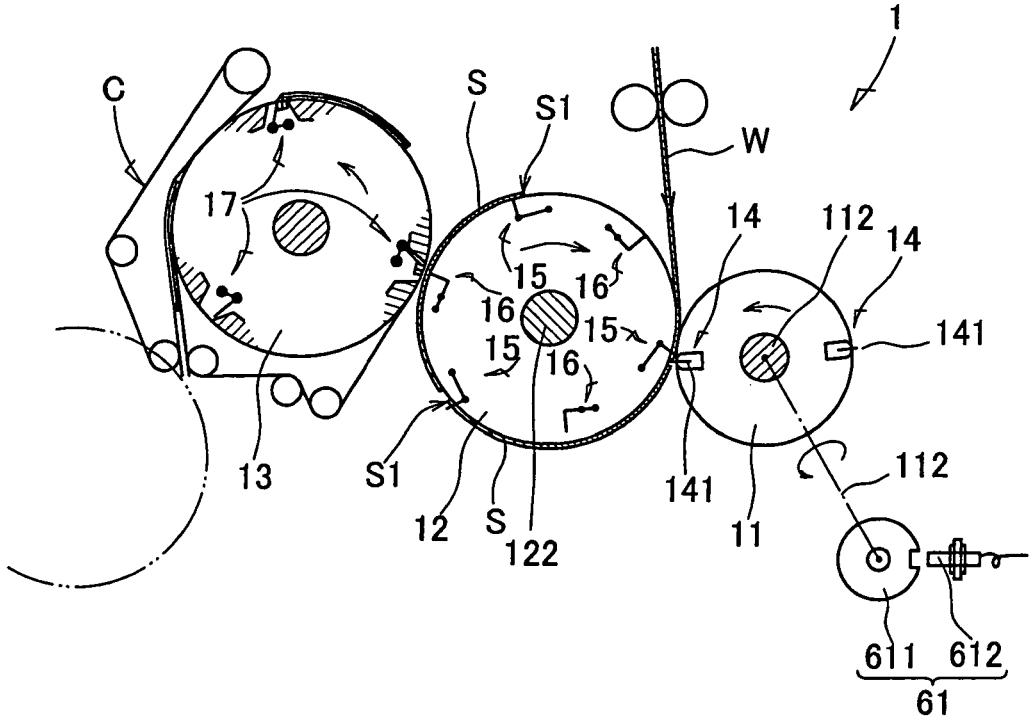
FIG. 5 is a cylinder arrangement view seen from arrows B-B in FIG. 1.

An embodiment of a folding apparatus of a rotary press according to the present invention will now be described with reference to the accompanying drawings. As shown in FIG. 5, the folding apparatus of a rotary press (which will be referred to as a folding apparatus hereinafter) according to the present invention includes a cutting cylinder 11 which cuts a printed paper web W, a folding cylinder 12 which carries a print paper sheet S obtained by cutting the printed paper web W so as to wind it around an outer periphery thereof, and a jaw cylinder 13 which doubles back and carries the printed paper sheet S carried by the folding cylinder 12 so as to wind it around an outer periphery thereof, the folding cylinder 12 is arranged between the cutting cylinder 11 and the jaw cylinder 13, and they are provided in such a manner that their outer peripheries are adjacent to one another. Further, as shown in FIGS. 1 to 3 and 13, the folding apparatus includes a fixed pin cam 2 fixed to a frame F, a correction pin cam 3 which is provided so as to be adjacent to the fixed pin cam 2 and is integral with a cam gear 33 provided so as to be capable of rotating around a shaft center of the folding cylinder 12, a blade cam 4 which is integrally provided so as to be adjacent to the correction pin cam 3 and capable of rotating around the shaft center of the folding cylinder 12, and a switching device 6 which includes detecting means 61 for detecting a switching means 62 and a start-up timing of switching means 62 so as to rotate an intermediate shaft (which will be referred to as a clutch shaft hereinafter) 621 capable of rotating with the same number of revolutions as that of the cutting cylinder 11 in collect run and stop it in straight run, and which switches between collect run and straight run by switching the correction pin cam 3 and the blade cam 4 between a rotation drive state and a stop state.

Figure 4:
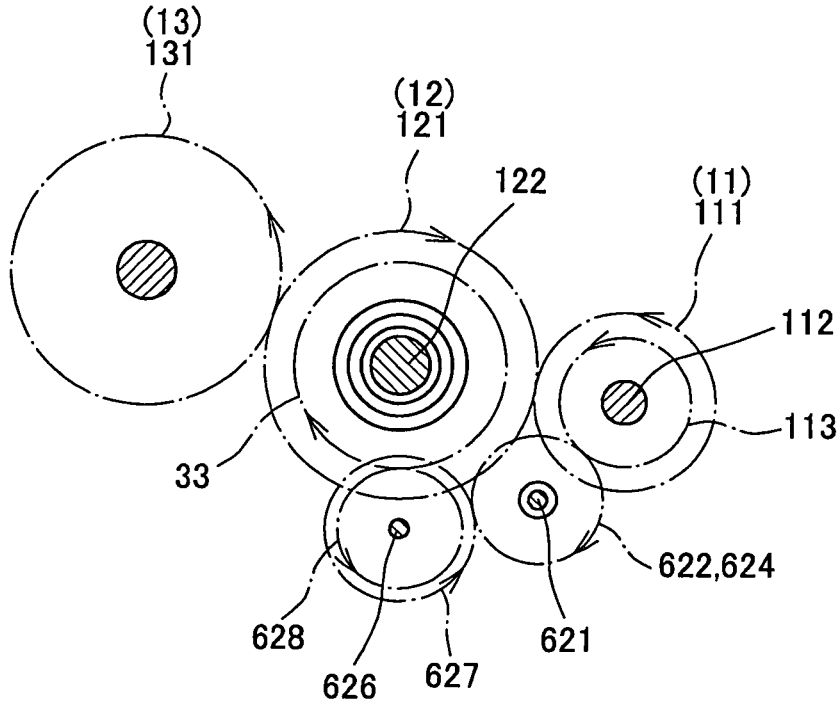
FIG. 4 is a gear drive path view seen from arrows A-A in FIG. 1.

Further, the cutting cylinder 11, the folding cylinder 12 and the jaw cylinder 13 are provided in such a manner that their outer peripheral surface lengths have a relationship of substantially 2:3:3 and, as shown in FIGS. 4 and 5, they are provided in such a manner that the folding cylinder 12 and the jaw cylinder 13 make a ⅔ rotation in cooperation with each other when the cutting cylinder 11 goes into a 360-degree roll by a cutting cylinder gear 111, a folding cylinder gear 121 and a jaw cylinder gear 131.

The cutting cylinder 11 includes cutting blade devices 14 which cuts a printed paper web W at two positions obtained by equally dividing an outer peripheral portion of the cutting cylinder 11, and cuts the printed paper web W in a direction perpendicular to a traveling direction of the printed paper web W at every half turn in a phase opposed to the folding cylinder 12. Furthermore, the cutting cylinder 11 has a circumferential length corresponding to twofold of a length of a print paper sheet cut to a fixed length.

The folding cylinder 12 has a diameter which is ⅔ of that of the cutting cylinder 11 adjacent thereto on one side, i.e., a circumferential length corresponding to threefold of a length of the print paper sheet S, and includes at three positions obtained by equally dividing the outer peripheral portion of the folding cylinder 12 pin devices 15 which thrust the vicinity of a cut portion S1 of the print paper sheet S on the leading side (which will be referred to as a leading end hereinafter) by using a plurality of pins 151 (see FIGS. 2 and 6) in a phase opposed to the cutting blade devices 14 and carry the print paper sheet S so as to wind it around the outer periphery of the folding cylinder 12. Moreover, the folding cylinder 12 has the same diameter as that of the jaw cylinder 13 adjacent thereto on the other side in a phase opposed to the jaw cylinder 13, and includes at three positions obtained by equally dividing the outer peripheral portion of the folding cylinder 12 blade devices 16 which put the print paper sheet S into jaw devices 17 (which will be described later) of the jaw cylinder 13 and pass it to them by blades 161 at a ½ position of the print paper sheet S wound around the outer periphery of the folding cylinder 12 and carried.

Figure 1:
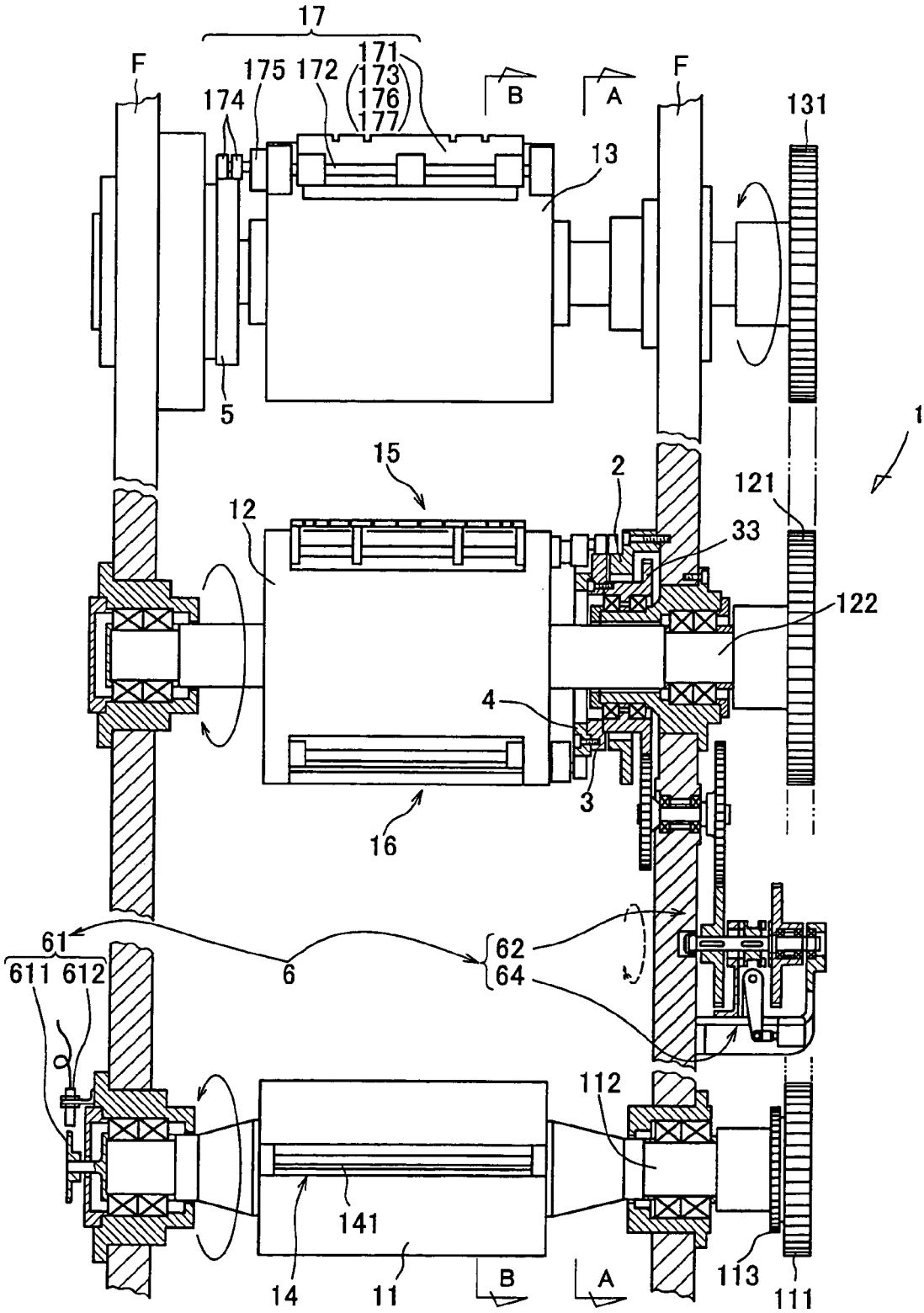
FIG. 1 is a partial cross-sectional plan view showing an embodiment of a folding apparatus according to the present invention.
Figure 2:
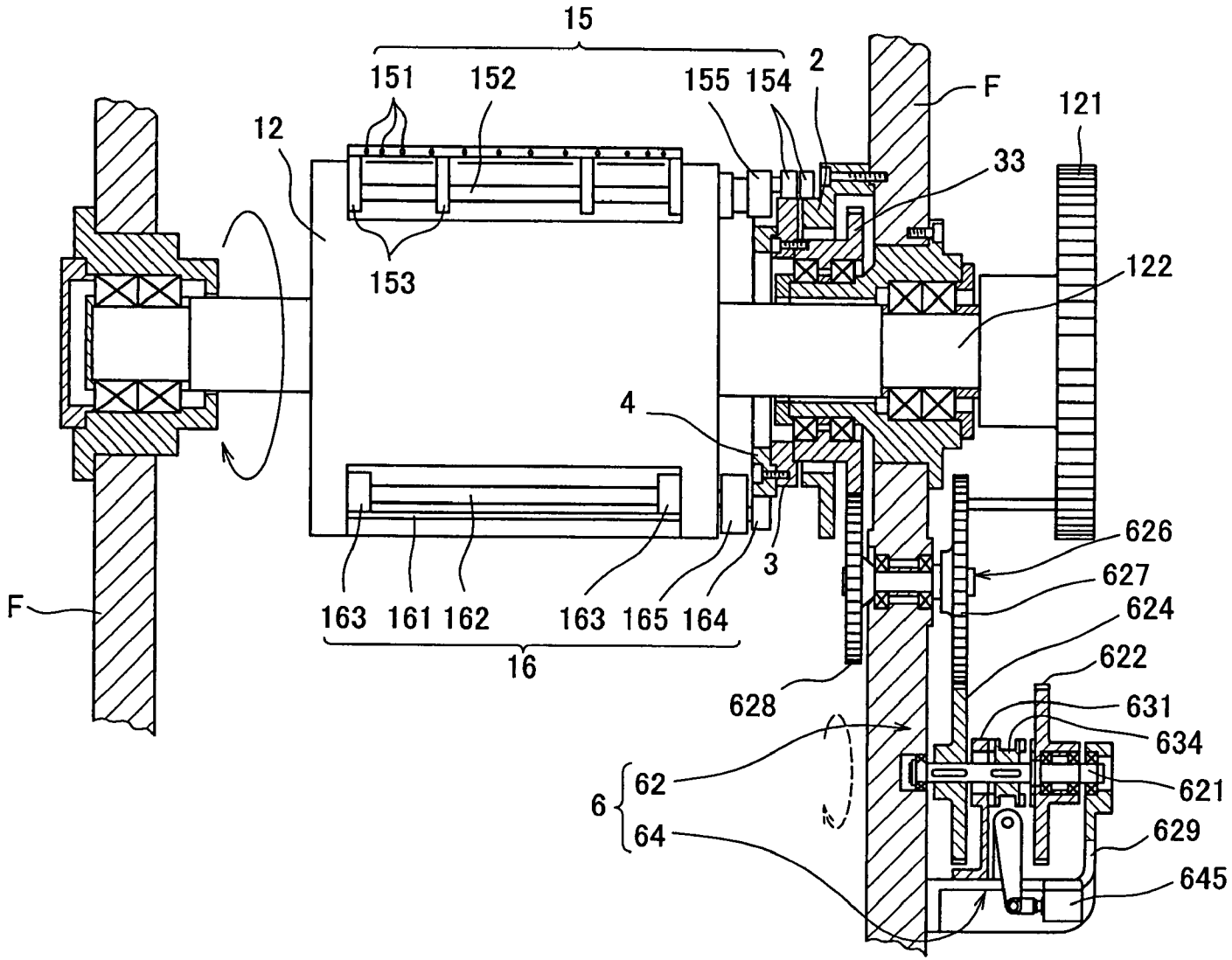
FIG. 2 is a partial plane view showing a part of a folding cylinder and a switching device in FIG. 1 in detail.
Figure 6:
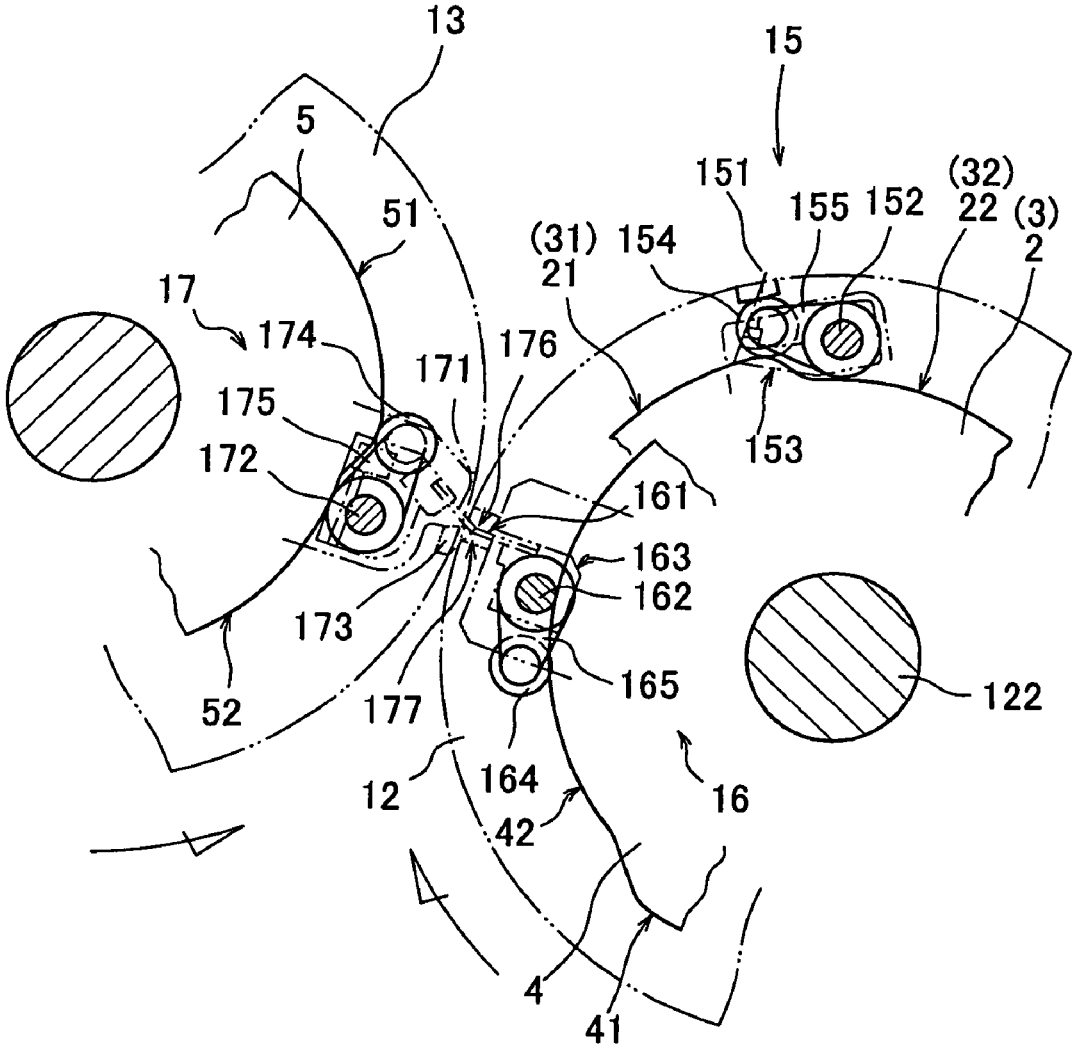
FIG. 6 is a partial cross-sectional view of the folding cylinder and a jaw cylinder.

As shown in FIGS. 1, 2 and 6, the pin device 15 is constituted of a pin shaft 152 rotatably provided to the folding cylinder 12, a pin arm 153 having one end side fixed to the pin shaft 152 and a pin 151 provided on the other end side, a cam follower 154 guided by both the fixed pin cam 2 and the correction pin cam 3, and an arm 155 having one end side fixed to an end portion side of the pin shaft 152 and the cam follower 154 provided on the other end side. Additionally, the pin 151 protrudes to the outer side of the outer periphery of the folding cylinder 12 when the cam follower 154 shifts from a trough portion 22 to a chevron portion 21 of the fixed pin cam 2 and, on the contrary, it is retired to the inner side of the outer periphery when the cam follower 154 shifts from the chevron portion 21 to the trough portion 22.

As shown in FIGS. 1, 2 and 6, the blade device 16 is constituted of a blade shaft 162 rotatably provided to the folding cylinder 12, a blade arm 163 having one end side fixed to the blade shaft 162 and a blade 161 provided on the other end side, a cam follower 164 guided by the blade cam 4, and an arm 165 having one end side fixed to an end portion side of the blade shaft 162 and the cam follower 164 provided on the other end side. Further, the blade 161 moves closer to the outer periphery of the folding cylinder 12 without having an end of the blade 161 protruding from the outer periphery of the folding cylinder 12 when the cam follower 164 shifts from the chevron portion 41 to the trough portion 42 of the blade cam 4 and, on the contrary, it moves from the position close to the outer periphery toward the central side when the cam follower 164 shifts from the trough portion 42 to the chevron portion 41 of the blade cam 4.

As shown in FIGS. 5 and 6, the jaw cylinder 13 includes jaw devices 17 which fold, hold and carry the printed paper sheet S put into the blade 161 in a phase opposed to the blade device 16 of the folding cylinder 12 at three positions obtained by equally dividing the outer peripheral portion of the jaw cylinder 13. The held print paper sheet S is released in the middle of rotation of the jaw cylinder 13, and passed to, e.g., a downstream conveyer C.

As shown in FIGS. 1, 5 and 6, the jaw device 17 is constituted of a holding cam 5 fixed to the frame F with the shaft center of the jaw cylinder 13 at the center, a holding shaft 172 rotatably provided to the jaw cylinder 13, a cam follower 174 guided by the holding cam 5, an arm 175 having one end fixed to an end portion side of the holding shaft 172 and the cam follower 174 provided on the other end side, a holding plate 171 provided to the holding shaft 172 in such a manner that an end portion 176 protrudes from the outer peripheral surface of the jaw cylinder 13, and a holding fixing member 173 provided so as to protrude from the outer periphery of the jaw cylinder 13 and is opposed to the holding plate 171. Furthermore, the holding plate 171 is opened so as to move away from the holding fixing member 173 when the cam follower 174 shifts from the chevron portion 51 to the trough portion 52 of the holding cam 5 and, on the contrary, it is closed so as to move closer to the holding fixing member 173 when the cam follower 174 shifts from the trough portion 52 to the chevron portion 51 of the holding cam 5. The end of the blade 161 of the blade device 16 which moves closer to the outer periphery of the folding cylinder 12 can be inserted between the opened holding plate 171 and the holding fixing member 173 without protruding from the outer periphery of the folding cylinder 12 (see FIG. 6).

Moreover, as shown in FIGS. 1 to 4 and 9, the switching device 6 is a device provided to rotate or stop the correction pin cam 3 and the blade cam 4 disposed so as to be capable of rotating around the shaft center of the folding cylinder 12 in accordance with collect run or straight run, and it consists of the switching means 62 which is provided in the middle of a gear train which rotates the correction pin cam 3 and the blade cam 4 and switches to either collect run or straight run and detecting means 61 for detecting a start-up timing of the switching means 62 on the basis of a phase of rotation of a drive source, i.e., a rotation phase of the cutting cylinder 11 in the illustrated embodiment.

As shown in FIG. 1, the detecting means 61 is constituted of a detection piece 611 provided to the cutting cylinder shaft 112 and a detector 612 which detects the detection piece 611. The detector 612 detects a detected part of the detection piece 611 only once per rotation of the cutting cylinder 11 in order to obtain the start-up timing of the switching means 62 for switching between collect run and straight run. Additionally, when switching between collect run and straight run, a detection signal is outputted by detecting the detected part with collect run or straight run being specified by a non-illustrated operation device, and the switching means 62 (see FIG. 9) starts its operation.

A structure of the switching means 62 will now be described. A structure which drives the correction pin cam 3 and the blade cam 4 consists of a gear drive mechanism shown in FIGS. 1 to 4. That is, a clutch shaft 621 which is an intermediate shaft and a cam drive shaft 626 are provided between a gear fixed to the cutting cylinder shaft 112 (which will be referred to as a gear a hereinafter) 113 and a cam gear 33 rotatably provided to the folding cylinder shaft 122 from the side close to the cutting cylinder shaft 112 (see FIG. 2). The both ends of the clutch shaft 621 are rotatably supported by the frame F and a bracket 629, a driven gear (which will be referred to as a gear b hereinafter) 622 (see FIGS. 2 and 3) which is meshed with the gear a 113 (see FIG. 1) is rotatably provided to the clutch shaft 621, and a boss end surface of the gear b 622 opposed to the frame F has a straight line type concave portion (which will be referred to as a concave portion of the gear b 622 hereinafter) 623 in a direction perpendicularly cutting across the shaft center of the clutch shaft 621 (see FIGS. 3 and 9). A fixing member 631 having a boss end surface opposed to an end surface of the gear b 622 is provided between the gear b 622 and the frame F, a straight line type concave portion (which will be referred to as a concave portion of the fixing member 631) 633 which perpendicularly cuts across the shaft center of the clutch shaft 621 is provided on the boss end surface opposed to the gear b 622, a hole 632 is formed at the center of this concave portion, and the clutch shaft 621 is supported by the frame F through this hole 632.

A clutch member 634 which is fitted to the clutch shaft 621 is provided between the boss end surface of the gear b 622 and the boss end surface of the fixing member 631, and the clutch member 634 can integrally rotate with the clutch shaft 621 by the key 625 and move with respect to the clutch shaft 621 in the axial direction. Straight line type convex portions 635 and 636 which perpendicularly cut across the shaft center of the clutch shaft 621 are provided on the both end surfaces of the clutch member 634 in the axial direction in phase, and they are designed to be fitted in the concave portion 623 of the gear b 622 or the concave portion 633 of the fixing member 631 when movement of the clutch member 634 on the clutch shaft 621 in the axial direction is completed. That is, the clutch member 634 can be connected with the gear b 622 at every time the gear b 622 rotates 180 degrees. Similarly, the clutch member 634 can be connected with the fixing member 631 at one connection position to which the disconnected clutch member 634 is rotated 180 degrees from the other connection position. The clutch member 634 has a groove 637 on the outer peripheral portion, and is connected to the movement mechanism 64 through the groove 637.

As shown in FIGS. 1 to 3, FIGS. 9 and 10A and FIG. 10B, the movement mechanism 64 has a guide roller 641 inserted into the groove 637 at one end, and it consists of a shift lever 642 fixed to a rotatable shaft 643, an operation lever 644 fixed to the shaft 643 and a pneumatic cylinder 645 connected to the other end of the operation lever 644. A cylinder rod 646 of the pneumatic cylinder 645 is connected to the other end of the operation lever 644, the shift lever 642 is subjected to angular displacement by expansion or contraction of the cylinder rod 646 of the pneumatic cylinder 645, and the clutch member 634 can be moved in the axial direction of the clutch shaft 621.

Further, when the clutch member 634 moves, the convex portion 635 is fitted in the concave portion 623, or the convex portion 636 is fitted in the concave portion 633. When one convex portion (which will be referred to as a first convex portion) 635 of the clutch member 634 is connected to the concave portion 623 of the gear b 622, the clutch shaft 621 rotates and enters a drive side connection state capable of driving. When the other convex portion (which will be referred to as a second convex portion) 636 of the clutch member 634 is connected to the concave portion 633 of the fixing member 631, the clutch shaft 621 stops and enters a stop side connection state.

An intermediate shaft gear (which will be referred to as a gear c hereinafter) 624 which is integral with the clutch shaft 621 is provided between the frame F and the fixing member 631, and it is meshed with a relay gear (which will be referred to as a gear d hereinafter) 627 (see FIG. 2) provided to the cam drive shaft 626.

As shown in FIGS. 2 and 4, the cam drive shaft 626 is rotatably supported by the frame F, and has a cam drive gear (which will be referred to as a gear e hereinafter) 628 on the side opposite to the gear d 627 with the frame F therebetween. The gear e 628 is meshed with the cam gear 33 rotatably provided with the shaft center of the folding cylinder 12 at the center. When the cutting cylinder 11 goes into a 360-degree roll (that is, the folding cylinder 12 makes a ⅔ rotation), the cam gear 33 (that is, the correction pin cam 3 and the blade cam 4) makes a ½ rotation in the same direction as the folding cylinder 12. That is, the correction pin cam 3 and the blade cam 4 are designed to rotate by a rotating quantity which is ¾ of that of the folding cylinder 12 in the same direction as the folding cylinder 12 (see FIG. 8).

Structures of the fixed pin cam 2 and the rotatable correction pin cam 3 and blade cam 4 will now be described. As shown in FIGS. 1, 2, 6 and 13, a trough portion 22 is provided to the fixed pin cam 2 at a part of its outer periphery forming a discoid shape, and the fixed pin cam 2 is fixed to the frame F side with the shaft center of the folding cylinder 12 at the center.

This cam is provided so as to cope with straight run that an end of the pin 151 temporarily enters the inner side with respect to the outer periphery of the folding cylinder 12 and immediately protrudes every time the cam follower 154 of the pin device 15 passes the trough portion 22 by rotation of the folding cylinder 12. A position of the trough portion 22 is set in such a manner that the pin 151 is prepared to enter the inner side of the outer periphery, come off the leading end S1 of the print paper sheet S and again protrude to be newly put into the printed paper web W when the print paper sheet S shown in FIG. 5 is carried to the jaw device 17.

Figure 14:
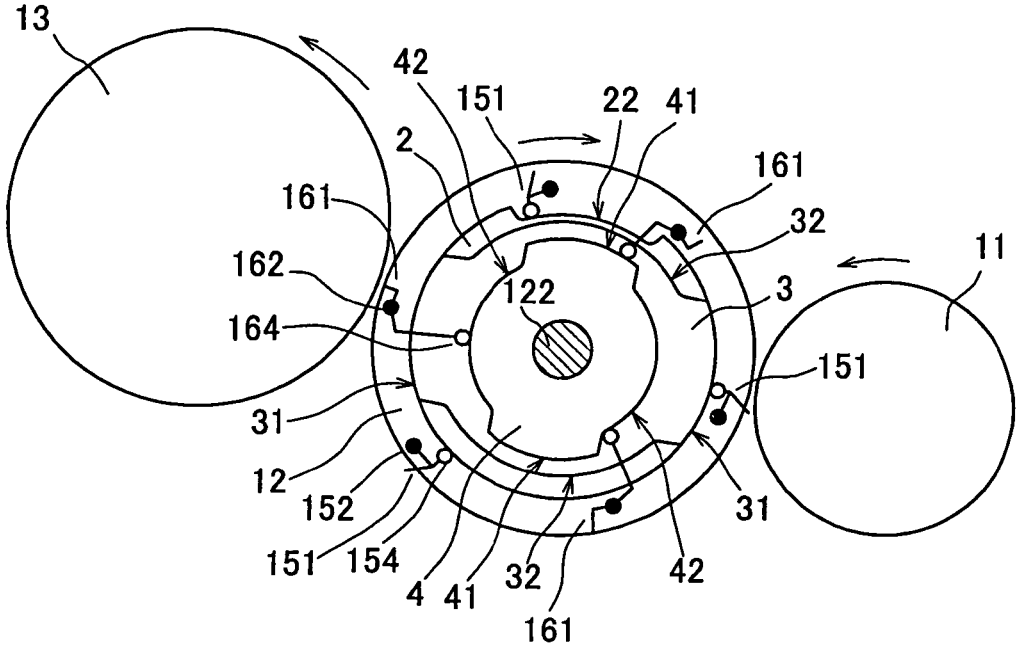
FIG. 14 is a phase relationship explanatory view of each cam in straight run with a position of a blade opposed to the jaw cylinder being determined as a reference.
Figure 15:
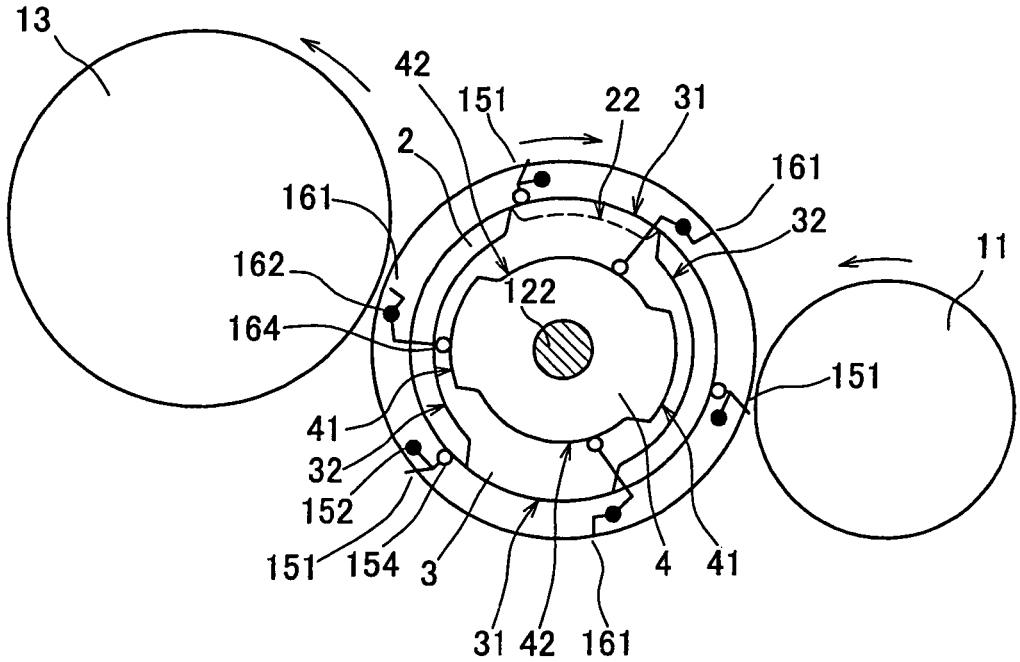
FIG. 15 is a phase relationship explanatory view of each cam in collect run when the folding cylinder makes a ⅓ rotation immediately after switching to collect run in FIG. 14.

As shown in FIGS. 1, 2, 6 and 13, the correction pin cam 3 is provided so as to be adjacent to the fixed pin cam 2, and includes a chevron portion 31 having the same outside diameter as that of the chevron portion 21 which is the outer periphery of the fixed pin cam 2 and a trough portion 32 having substantially the same outer shape as that of the trough portion 22. Furthermore, this cam can rotate around the shaft center of the folding cylinder 12. As shown in FIG. 15, the chevron portion 31 of the correction pin cam 3 has substantially the same length as a circumferential length of the trough portion 22 of the fixed pin cam 2, and the chevron portion 31 is provided at two positions with a phase of 180 degrees. Moreover, in order to cope with straight run, as shown in FIG. 14, the chevron portion 31 of the correction pin cam 3 stops at a position deviant from the trough portion 22 of the fixed pin cam 2.

Figure 13:
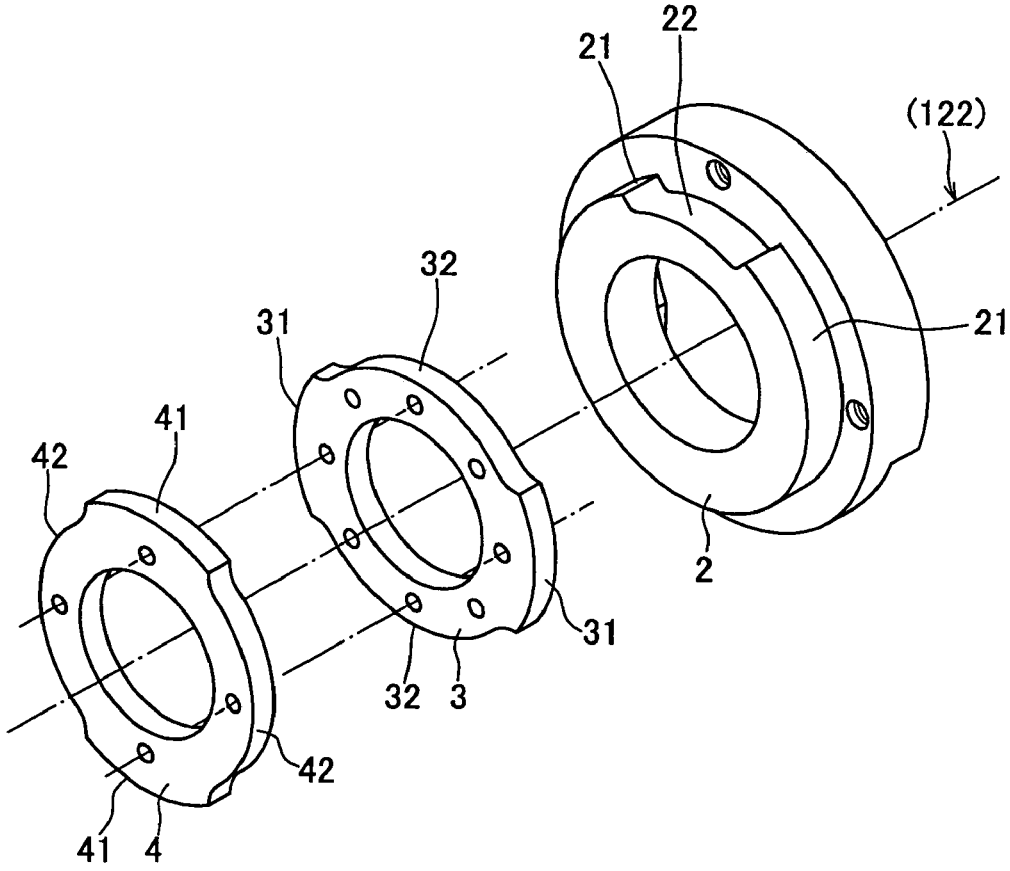
FIG. 13 is a perspective explanatory view of cam profiles of a fixed pin cam, a correction pin cam and a blade cam.

As shown in FIGS. 6 and 13, the blade cam 4 has chevron portions 41 provided at two positions with a phase of 180 degrees like the correction pin cam 3, and can rotate around the shaft center of the folding cylinder 12 integrally with the correction pin cam 3 (see FIGS. 1 and 2). The blade cam 4 forms a cam profile which operates the end of the blade 161 so as to move closer to the outer periphery of the folding cylinder 12 without protruding from the outer periphery of the folding cylinder 12 by shifting the cam follower 164 from the chevron portion 41 to the trough portion 42, and which operates the same so as to move from the position close to the outer periphery toward the central side by shifting the cam follower 164 from the trough portion 42 to the chevron portion 41. When coping with straight run, i.e., when the chevron portion 31 of the correction pin cam 3 stops at a position deviant from the trough portion 22 of the fixed pin cam 2 as shown in FIG. 14, the blade 161 opposed to the jaw cylinder 13 can be placed at a position close to the outer periphery of the folding cylinder 12 (see FIG. 6).

A description will now be given as to an effect when switching from collect run to straight run or switching from straight run to collect run in the embodiment of the folding apparatus according to the present invention with reference to FIGS. 1 to 3 and FIGS. 9 to 12.

Figure 11:
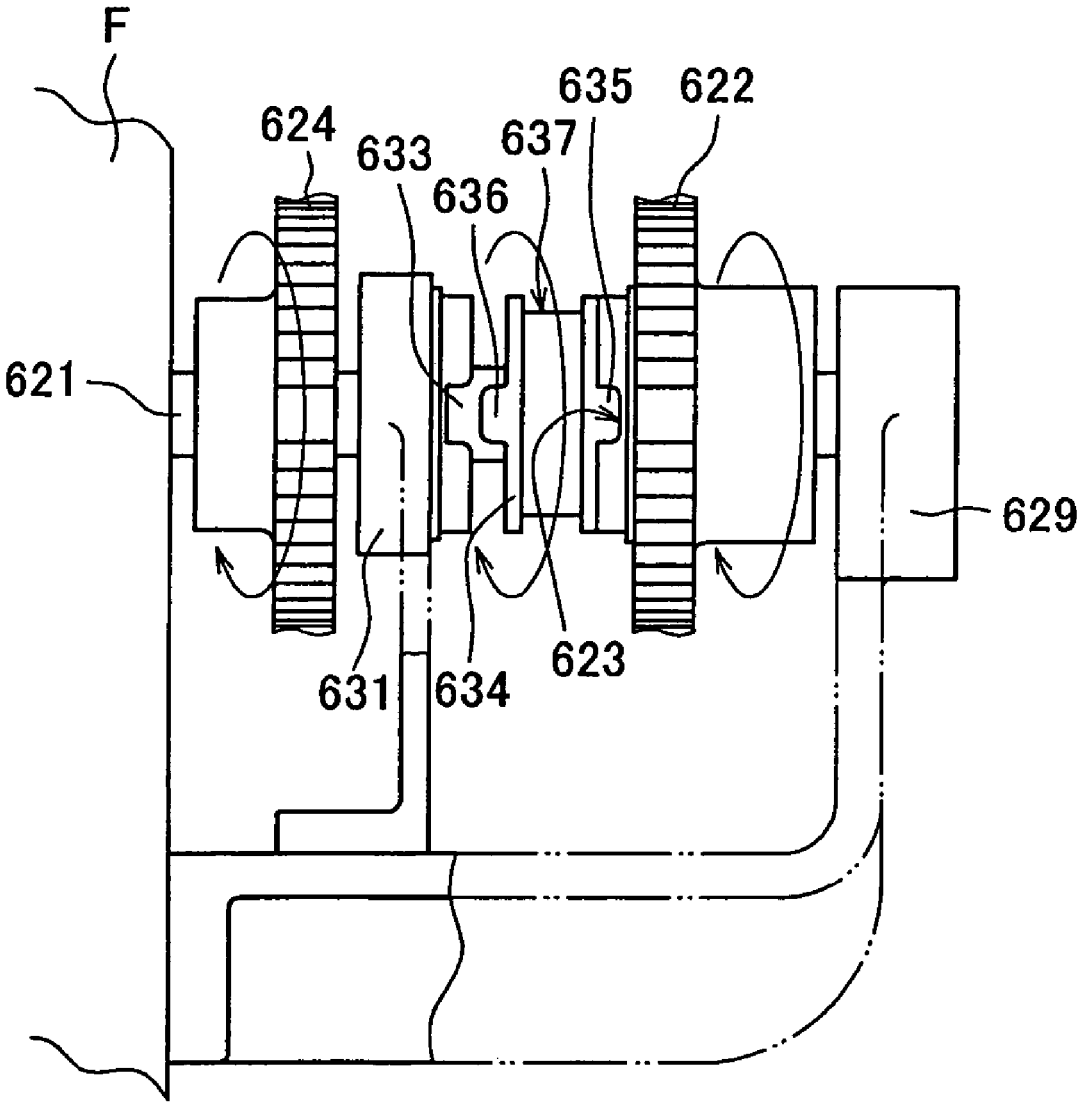
FIG. 11 is an operation explanatory view of the clutch member which switches to straight run.
Figure 12A:
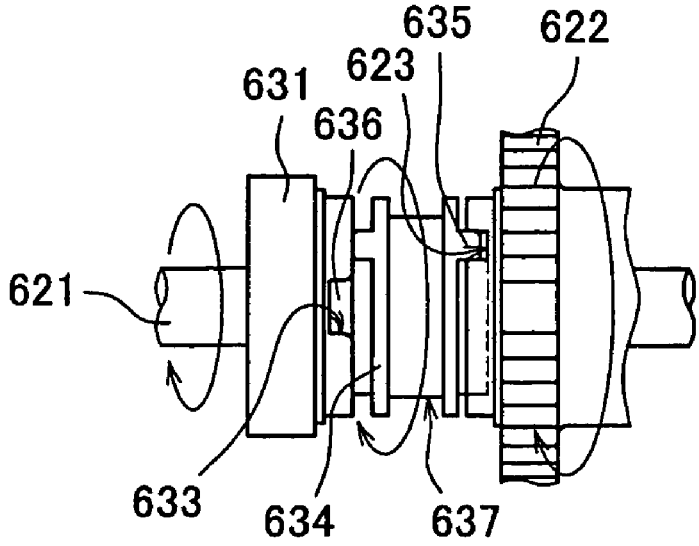
FIG. 12 is operation explanatory views showing the operation state following FIG. 11 in the order of FIGS. 12A and 12B;.
Figure 12B:
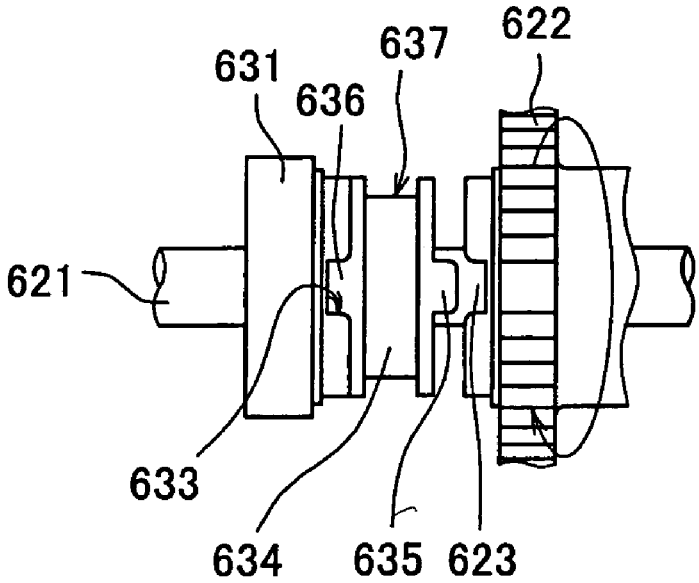

When switching from collect run to straight run, the folding apparatus 1 is operated at a low speed, and the cutting cylinder 11, the folding cylinder 12 and the jaw cylinder 13 are rotated at a predetermined speed. Moreover, when straight run is specified by a non-illustrated operation device which can specify either collect run or straight run and a detected portion of the detection piece 611 which rotates with the cutting cylinder 11 is detected by the detecting means 61, an operation signal corresponding to the specified and selected run is outputted by a non-illustrated control device in accordance with the first detection. Then, the cylinder rod 646 of the pneumatic cylinder 645 provided to the movement mechanism 64 shown in FIG. 3 operates in a direction to retire according to the operation signal. Subsequently, as shown in FIG. 11, the first convex portion 635 of the clutch member 634 is fitted in and connected with the concave portion 623 of the gear b 622, and the clutch member 634 which transmits rotation of the gear b 622 to the clutch shaft 621 moves toward the fixing member 631 as shown in FIG. 12B through a state depicted in FIG. 12A. That is, the operation lever 644 is operated by retraction of the cylinder rod 646, and the shift lever 642 is operated through the shaft 643. Then, the side wall of the groove 637 of the clutch member 634 is pushed toward the fixing member 631 side in the axial direction by the guide roller 641 provided on the end side of the shift lever 642, and the clutch member 634 moves in a direction to be disconnected from the gear b 622 while rotating. Subsequently, the end surface of the second convex portion 636 of the clutch member 634 comes into contact with the end surface of the fixing member 631 provided so as to be opposed to the second convex portion 636 of the clutch member 634. In a state that the end surface of the second convex portion 636 is in contact with the end surface of the fixing member 631, since the first convex portion 635 of the clutch member 634 is not disconnected from the concave portion 623 of the rotating gear b 622, the clutch member 634 maintains the rotating state. Therefore, the second convex portion 636 of the clutch member 634 rotates in contact with the end surface of the fixing member 631, and the correction pin cam 3 and the blade cam 4 integrally keep rotating. A rotation quantity with the end surface of the second convex portion 636 being in contact with the end surface of the fixing member 631 can be changed within a range of 180 degrees of a displacement quantity by appropriately varying an attachment phase of the detection piece 611 with respect to the cutting cylinder 11.

Figure 3:
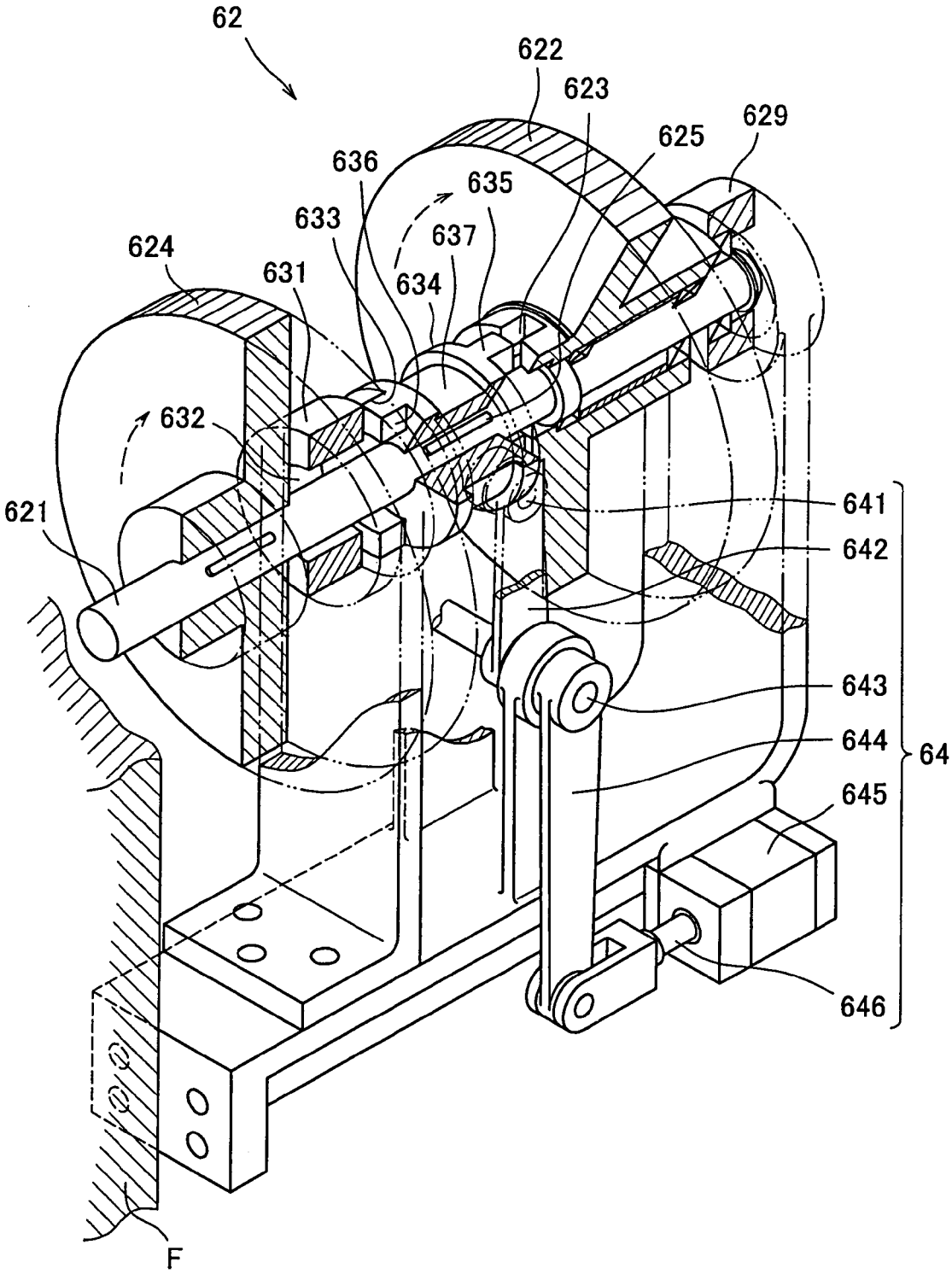
FIG. 3 is a partial cross-sectional perspective view of the switching means depicted in FIGS. 1 and 2.

Then, when a position of the second convex portion 636 of the clutch member 634 matches with a position of the concave portion 633 on the end surface of the fixing member 631, as shown in FIGS. 3 and 12B, the second convex portion 636 is fitted in the concave portion 633 of the fixing member 631 and connected on the stop side by an action force of the pneumatic cylinder 645, and the other first convex portion 635 comes off the concave portion 623 of the gear b 622 to cancel the connection, thereby stopping rotation of the clutch shaft 621. Since a length of the clutch member 634 from a protruding end of the first convex portion 635 to a protruding end of the second convex portion 636 is slightly larger than a distance between the opposed end surfaces of the gear b 622 and the fixing member 631, the drive side connection between the first convex portion 635 and the concave portion 623 of the gear b 622 and the stop side connection are instantaneously attained when switching to the stop side connection of the clutch member 634. By the stop based on this stop side connection, the chevron portion 31 of the correction pin cam 3 which is in the state shown in FIG. 15 changes the phase with respect to the trough portion 22 of the fixed pin cam 2 by 90 degrees and stops at a position where it does not overlap the trough portion 22 as shown in FIG. 14. At this stop position, in the blade cam 4, when the blade 161 reaches a position at which it is opposed to the jaw cylinder 13, the trough portion 42 is placed at a position where the operation to move the blade 161 closer to the outer periphery of the folding cylinder 12 is operated. In this series of operations, switching to straight run is completed. After the correction pin cam 3 and the blade cam 4 are switched to straight run, the pin 151 of the pin device 15 is thrust into the printed paper web W successively supplied to the folding apparatus 1, and this paper web W is cut by the cutting blade 141 of the cutting blade device 14 at a position on the slightly downstream side away from the thrust position. When the folding cylinder 12 further makes a ⅓ rotation, a rear end of the printed paper web W thrust by the pin 151 at a position close to the leading end S1 is cut away, turned to the print paper sheet S, and carried to the jaw cylinder 13 side (see FIGS. 5 and 7).

That is, as shown in FIG. 6, the pin device 15 of the folding cylinder 12 operates the pin 151 in cooperation with rotation of the folding cylinder 12 and a movement of the cam follower 154 which rotates around the outer periphery of the fixed pin cam 2. The pin device 15 thrusts the pin 151 into the printed paper web W at a position opposed to the cutting cylinder 11 and carries the print paper sheet S as it is with the end of the pin 151 being caused to protrude from the outer periphery of the folding cylinder 12 by the chevron portion 21 of the fixed pin cam 2. When the leading end S1 of the print paper sheet S passes through the position opposed to the jaw cylinder 13 and then advances by a distance corresponding to substantially ½ of the length of the print paper sheet S, the pin 151 is temporarily retired from the outer periphery of the folding cylinder 12 by the trough portion 22 of the fixed pin cam 2, and the pin 151 comes off the print paper sheet S. As shown in FIG. 14, the two chevron portions 31, 31 of the correction pin cam 3 have a phase of 180 degrees, and these chevron portions 31, 31 stop in phase shifted by 90 degrees from the trough portion 22 of the fixed pin cam 2. Therefore, they do not relate to a movement of the pin 151 in case of straight run (see FIG. 7).

On the other hand, as shown in FIG. 6, the blade device 16 of the folding cylinder 12 operates the blade 161 in cooperation with the movement of the cam follower 164 which rotates around the outer periphery of the stopped blade cam 4 with rotation of the folding cylinder 12. The blade cam 4 stops integrally with the correction pin cam 3 and, when the blade 161 is opposed to the jaw device 17 provided to the jaw cylinder 13 as shown in FIGS. 6 and 14, i.e., when the leading end S1 of the print paper sheet S passes through the position opposed to the jaw cylinder 13 and then advances by a distance corresponding to substantially ½ of the length of the print paper sheet S as shown in FIG. 5, the blade 161 is inserted into to the jaw device 17 by the trough portion 42 of the blade cam 4. It is to be noted that the blade 161 does not protrude from the outer periphery of the folding cylinder 12 in this invention, and hence it does not interfere with the outer periphery of the cutting cylinder 11 as well as the printed paper web W between the cutting cylinder 11 and the folding cylinder 12 when opposed to the cutting cylinder 11.

Moreover, since an end portion 176 of the holding plate 171 of the jaw device 17 and an end portion 177 of the holding fixing member 173 are provided so as to protrude from the outer periphery of the jaw cylinder 13 as shown in FIG. 6, when the leading end S1 of the print paper sheet S thrust by the pin 151 passes through the part at which the folding cylinder 12 is opposed to the jaw cylinder 13 and advances to the vicinity of the position corresponding to approximately ½ of the length of the print paper sheet S, at a part where the folding cylinder 12 is opposed to the jaw cylinder 13, the end portions 176, 177 of the jaw device 17 enter the circumference of the folding cylinder 12 in a space in which the blade device 16 is provided and the blade 161 which is close to the outer periphery of the folding cylinder 12 enters between the holding plate 171 and the holding fixing member 173 by the trough portion 42 of the blade cam 4. Then, with a timing substantially matching with this, the pin 151 is retired to the inner side of the outer periphery of the folding cylinder 12 by the trough portion 22 of the fixed pin cam 2, and comes off the print paper sheet S. Additionally, the blade 161 comes off the jaw device 17 with rotation of the folding cylinder 12, and the jaw device 17 sandwiches the central part of the print paper sheet S inserted by the blade 161 by closing the holding plate 171, doubles back and holds the print paper sheet S. The holding plate 171 is opened in the middle of rotation of the jaw cylinder 13, and the held print paper sheet S carried with rotation of the jaw cylinder 13 is released and carried to the downstream conveyer C (see FIG. 5).

Figure 7:
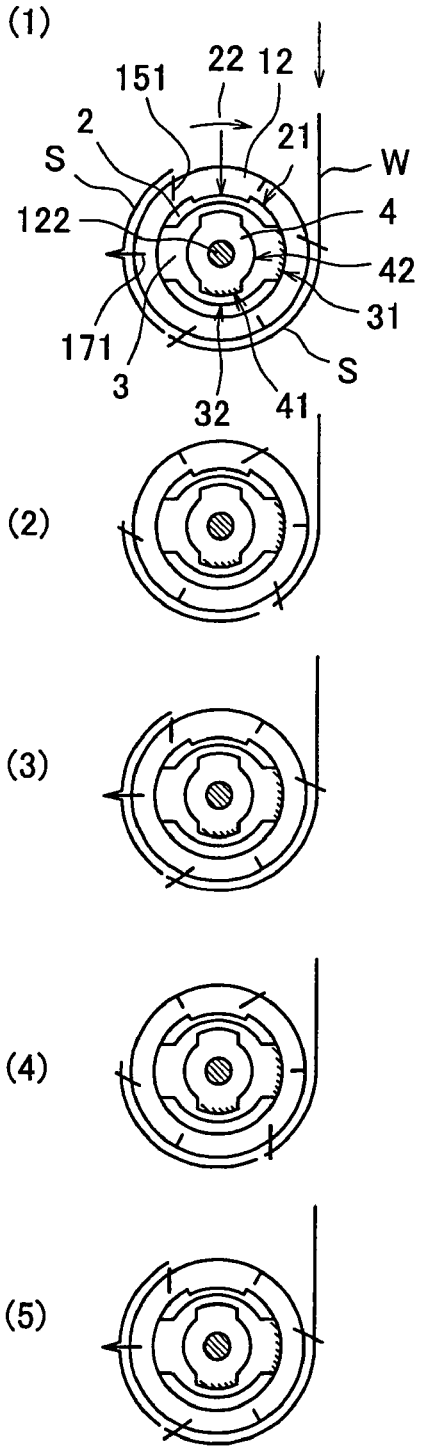
FIG. 7 is operation explanatory views of a print paper sheet on the folding cylinder which is folded in straight run.

That is, in case of straight run, as shown in FIG. 14, the chevron portion 31 of the stopped correction pin cam 3 does not concern the movement of the pin 151 at all, sequentially operates the pin devices 15 and the blade devices 16 provided at three positions on the folding cylinder 12 shown in FIGS. 5 and 6, receives the print paper sheet S obtained by cutting the printed paper web W at every ½ rotation of the cutting cylinder 11 by thrusting the pin 151 of the pin device 15 of the folding cylinder 12 as shown in FIG. 7 illustrating the operation of the print paper sheet S folded in case of straight run, and the folding cylinder 12 sequentially carries and passes the print paper sheet S to the jaw cylinder 13 by using the blade 161.

Figure 9:
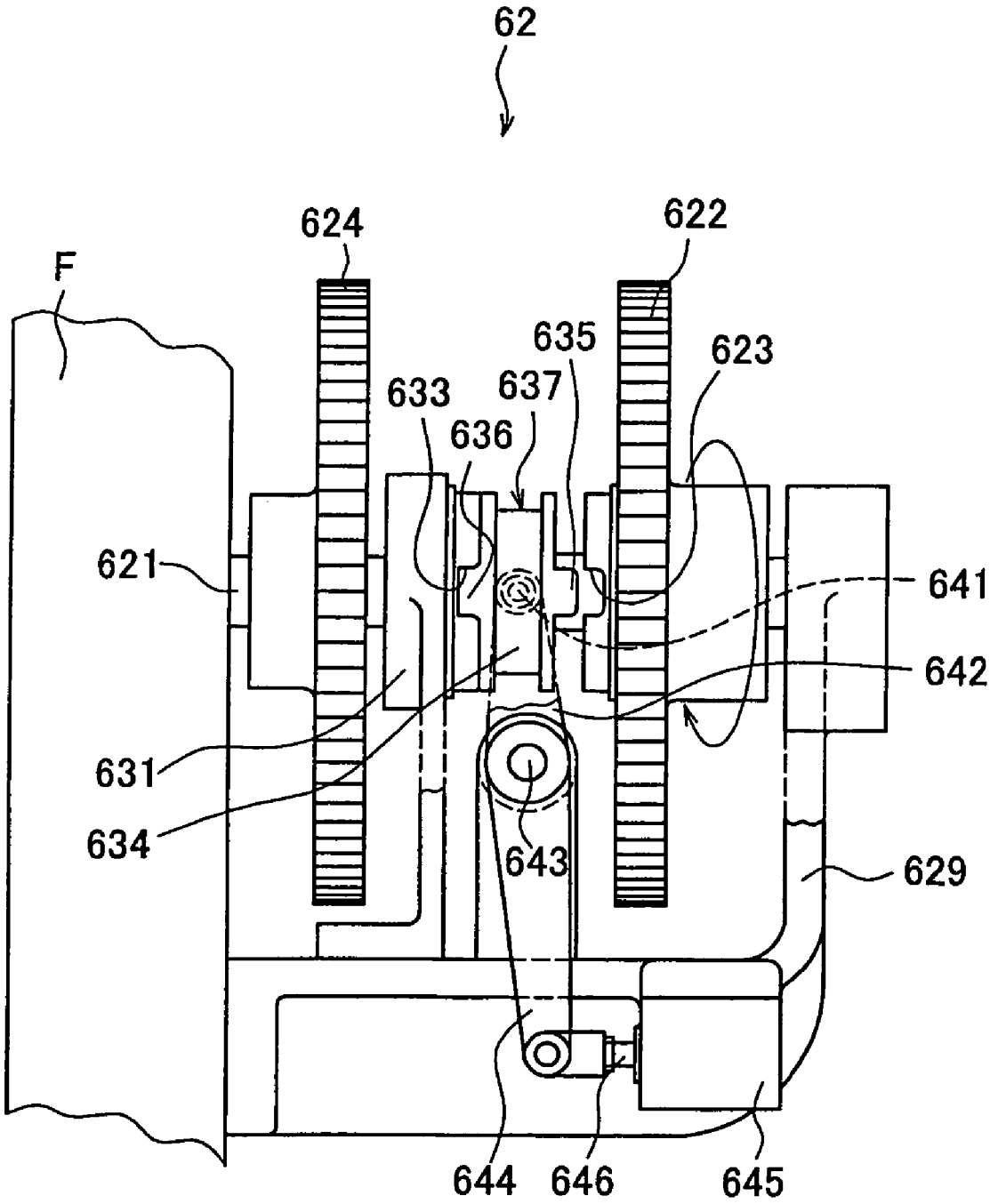
FIG. 9 is an operation explanatory view of a clutch member which switches to collect run.
Figure 10A:
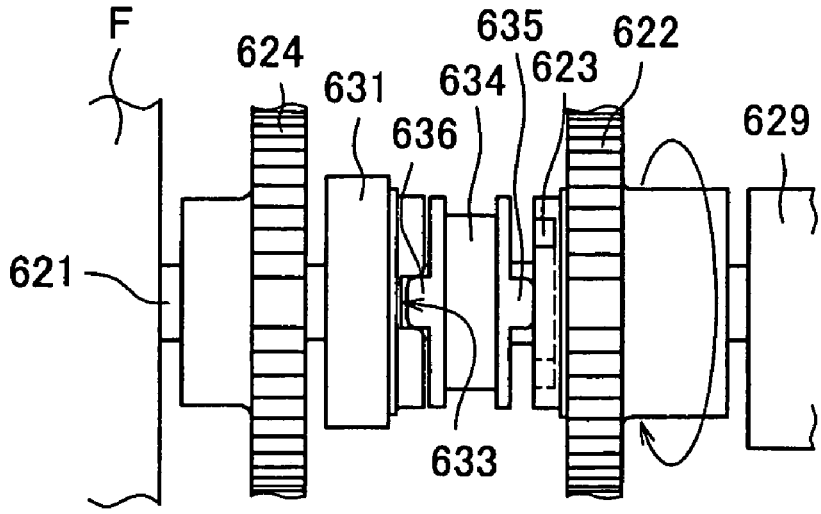
FIG. 10 is operation explanatory views showing the operation state following FIG. 9 in the order of FIGS. 10A and 10B.

Subsequently, when switching from straight run to collect run, the folding apparatus 1 is operated at a low speed, and the cutting cylinder 11, the folding cylinder 12 and the jaw cylinder 13 are rotated at a predetermined speed. Then, collect run is specified by a non-illustrated operation device which can specify either collect run or straight run. Further, when the detected portion of the detection piece 611 which rotates together with the cutting cylinder 11 is detected by the detecting means 61, an operation signal corresponding to the specified run is outputted by the control device in accordance with the first detection like the case of switching to straight run. Then, the cylinder rod 646 of the pneumatic cylinder 645 provided to the movement mechanism 64 is operated in the expanding direction according to the operation signal. Subsequently, as shown in FIG. 9, the second convex portion 636 of the clutch member 634 is fitted in and connected with the concave portion 633 of the fixing member 631, and the clutch member 634 which has stopped the clutch shaft 621 moves toward the gear b 622 as shown in FIG. 10A. That is, in the clutch member 634, the operation lever 644 is actuated by expansion of the cylinder rod 646, and the shift lever 642 is operated through the shaft 643. Then, the side wall of the groove 637 of the clutch member 634 is pushed toward the gear b 622 side in the axial direction by the guide roller 641 provided at the end portion of the shift lever 642 and moves in a direction to cancel the connection with the fixing member 631. Subsequently, the end surface of the first convex portion 635 of the clutch member 634 is brought into contact with the end surface of the rotating gear b 622 which is provided so as to be opposed to the first convex portion 635 of the moving clutch member 634. In a state that the end surface of the first convex portion 635 is in contact with the end surface of the gear b 622, since the second convex portion 636 of the clutch member 634 is not disconnected from the concave portion 633 of the fixing member 631, the clutch member 634 maintains the stopped state. Therefore, the end surface of the first convex portion 635 of the clutch member 634 is stopped being in contact with the end surface of the rotating gear b 622, the clutch shaft 621 cannot rotate while the connection with the fixing member 631 is not canceled. The correction pin cam 3 and the blade cam 4 maintain the stopped state at a position shown in FIG. 14. A rotation quantity of the gear b 622 in a state that the end surface of the gear b 622 is in contact with the end surface of the first convex portion 635 can be changed within a range of 180 degrees of a displacement quantity by appropriately varying an attachment phase of the detection piece 611 (see FIG. 1) relative to the cutting cylinder 11 as described above.

Figure 8:
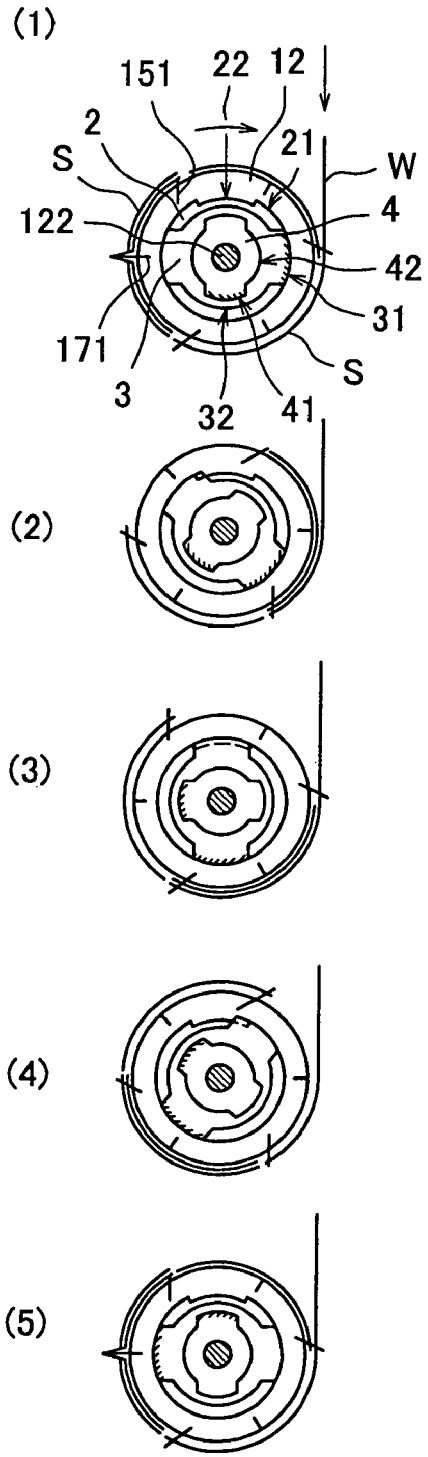
FIG. 8 is operation explanatory views of a print paper sheet on the folding cylinder which is folded in collect run.
Figure 10B:
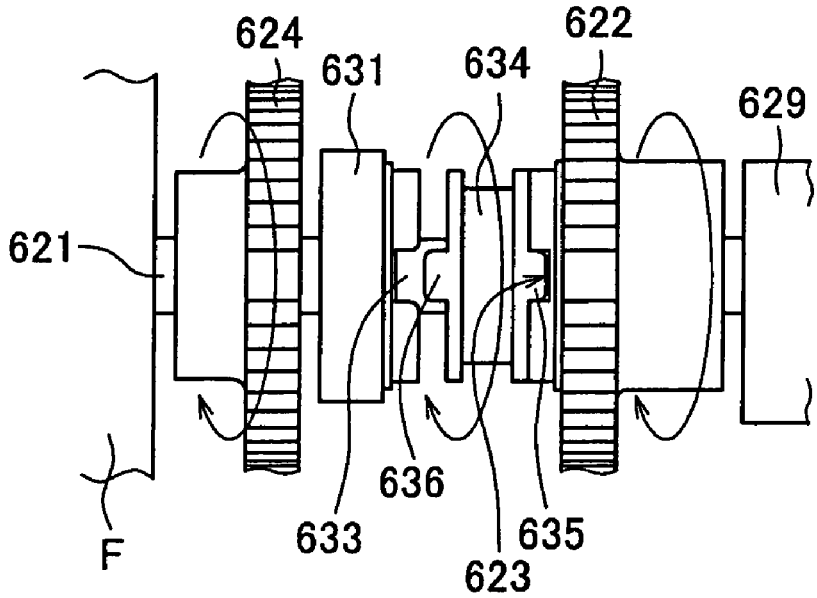

Subsequently, when a position of the first convex portion 635 of the clutch member 634 matches with a position of the end surface of the gear b 622, as shown in FIGS. 3 and 10B, the first convex portion 635 is fitted into the concave portion 623 of the gear b 622 and connected on the drive side by the action force of the pneumatic cylinder 645, the other second convex portion 636 comes off the concave portion 633 of the fixing member 631 to cancel the connection, and the stopped clutch shaft 621 starts rotation. At the time of switching to the drive side connection, instantaneously achieving both the stop side connection and the drive side connection is the same as that of switching to the stop side connection. When the clutch shaft 621 is connected with the gear b 622 and rotates, as shown in FIGS. 1 and 2, the correction pin cam 3 and the blade cam 4 which are integral with the cam gear 33 rotate through the gear c 624, the gear d 627, the gear e 628 and the cam gear 33. Therefore, as shown in FIGS. 8 and 15, the correction pin cam 3 and the blade cam 4 make a ½ rotation around the shaft center of the folding cylinder 12 when the cutting cylinder 11 makes one rotation, and they make a ¾ rotation when the folding cylinder 12 makes one rotation. Thus, when the folding cylinder 12 rotates by an amount equal to the outer peripheral length corresponding to the length of the print paper sheet S, i.e., when it makes a ⅓ (120-degree) rotation, the correction pin cam 3 and the blade cam 4 make a ¼ (90-degree) rotation. Therefore, when the folding cylinder 12 makes a ⅓ rotation with a position of the blade 161 opposed to the jaw cylinder 13 depicted in FIG. 6 being determined as a reference, the correction pin cam 3 and the blade cam 4 which integrally rotate make a ¼ rotation and move to a position shown in FIG. 15 from a position depicted in FIG. 14. At this time, since the chevron portion 31 of the correction pin cam 3 covers the trough portion 22 of the fixed pin cam 2, the cam follower 154 of the pin device 15 does not fall in the trough portion 22, and the pin 151 does not come off the print paper sheet S while protruding from the outer periphery of the folding cylinder 12. On the other hand, since the chevron portion 41 of the blade cam 4 pushes up the cam follower 164 of the blade device 16 and the blade 161 opposed to the jaw cylinder 13 is retired to the central side of the folding cylinder 12, the print paper sheet S passes by without being inserted between the holding plate 171 and the holding fixing member 173, and is carried toward the portion opposed to the cutting cylinder 11 by the pin 151 while being wound around the folding cylinder 12 (see FIG. 8).

Moreover, when the folding cylinder 12 makes a ⅓ rotation from the state shown in FIG. 15, the correction pin cam 3 and the blade cam 4 make a ¼ rotation and reach a position depicted in FIG. 14. At this time, since the chevron portion 31 of the correction pin cam 3 does not cover the trough portion 22 of the fixed pin cam 2, the cam follower 154 of the pin device 15 falls in the trough portion 22, and the pin 151 processes the inner side from the outer periphery of the folding cylinder 12 and comes off the print paper sheet S. On the other hand, since the chevron portion 41 of the blade cam 4 moves from the position depicted in FIG. 15 to a phase of 90 degrees, the cam follower 164 of the blade device 16 falls in the trough portion 42. Additionally, since the blade 161 opposed to the jaw cylinder 13 is close to the outer periphery of the folding cylinder 12, the print paper sheet S is inserted and held between the holding plate 171 and the holding fixing member 173 at a ½ position in the lengthwise direction by the blade 161 and passed to the jaw cylinder 13.

The pin device 15 thrusting the pin 151 into the passing print paper sheet S and holding this paper sheet is again opposed to the cutting blade device 14 of the cutting cylinder 11 by rotation of the folding cylinder 12, superposes a new print paper sheet S on the print paper sheet S and thrusts the pin 151 into them, and carries the two-ply print paper sheet S to the portion opposed to the jaw cylinder 13. When the blade device 16 moves to the position opposed to the jaw device 17 of the jaw cylinder 13, the cam follower 164 of the blade 161 is in the trough portion 42 of the rotating blade cam 4, the blade 161 is close to the outer periphery of the folding cylinder 12, and the central part of the two-ply print paper sheet S is put into the jaw device 17. With substantially the same timing as this, the cam follower 154 of the pin 151 temporarily falls in the trough portion 22 of the fixed pin cam 2, and the pin 151 comes off the print paper sheet S. The two-ply print paper sheet S is held by the jaw device 17 of the jaw cylinder 13, folded and carried to the downstream side. Then, the subsequent non-superposed print paper sheet S passes by without being held by the opposed jaw device 17.

That is, in case of collect run, as shown in FIG. 8, the print paper sheet S obtained by cutting the printed paper web W at every ½ rotation of the cutting cylinder 11 is passed to the folding cylinder 12 and carried and, when the correction pin cam 3 and the blade cam 4 which rotate with respect to the fixed pin cam 2 make a ¾ rotation while the folding cylinder 12 makes one rotation, the pin device 15 at each of three position provided to the folding cylinder 12 and the blade device 16 which is on the downstream side in the rotating direction of the folding cylinder 12 with respect to the pin device 15, in pairs, act on the jaw device 17 of the jaw cylinder 13 so as to hold the two-ply print paper sheet S once per two rotations of the folding cylinder 12.

Therefore, the folding apparatus according to the present invention has one fixed pin cam 2 provided on one end side of the folding cylinder 12, the correction pin cam 3 and the blade cam 4 which are provided so as to be adjacent to the fixed pin cam 2 and can integrally rotate or stop, and the switching device 6 which can switch to either collect run or straight run. When either run is specified by a non-illustrated operation device which can selectively specify collect run or straight run, the clutch shaft 621 which can rotate with the same number of revolutions as that of the cutting cylinder 11 is automatically rotated or stopped. Further, in case of collect run, when the integral correction pin cam 3 and blade cam 4 which can rotate relative to the fixed pin cam 2 are rotated by the rotating clutch shaft 621, the two-ply print paper sheet S is folded and discharged at every time the jaw cylinder 13 makes a ⅔ rotation. Furthermore, in case of straight run, when the integral correction pin cam 3 and blade cam 4 which can rotate or stop with respect to the fixed pin cam 2 are stopped by the stopped clutch shaft 621, the print paper sheet S is folded one by one and discharged at every time the jaw cylinder 13 makes a ⅓ rotation.

In the illustrated embodiment of the folding apparatus, a cylinder diameter ratio of the cutting cylinder 11, the folding cylinder 12 and the jaw cylinder 13 is 2:3:3, the folding cylinder 12 and the jaw cylinder 13 make a ⅓ rotation when the cutting cylinder 11 makes a ½ rotation, and a movement length of the outer periphery of each cylinder in these rotation quantities corresponds to a length of the print paper sheet S. However, even if the cutting cylinder 11, the folding cylinder 12 and the jaw cylinder 13 have another cylinder diameter ratio such as 2:5:5, the same effect can be obtained by appropriately setting the number of revolutions of the correction pin cam 3 and the blade cam 4 relative to the number of revolutions of the folding cylinder 12.

As described above, according to the embodiment of the present invention, collect run and straight run of the folding apparatus can be automatically and assuredly switched since there is a range that the convex portions provided at both end portions of the clutch member of the switching means can be simultaneously fitted in the respective opposed concave portions for a very short time during movement of the clutch member in the axial direction in such a manner that the correction pin cam and the blade cam which can integrally rotate relative to the fixed pin cam are rotated in case of collect run or stopped in case of straight run when the folding apparatus is operated at a low speed and the cutting cylinder, the folding cylinder and the jaw cylinder are rotated at a predetermined speed. Therefore, in switching between collect run and straight run in the folding apparatus, switching can be very easily carried out by only specifying either run type without requiring skills at all, the complicated switching operation is no longer necessary, the working efficiency at the time of switching can be improved, and the operating efficiency of the rotary press can be enhanced.

What is claimed is:

1. A folding apparatus of a rotary press, which includes: a cutting cylinder having at least one cutting blade device; a folding cylinder having at least one pin device and at least one blade device; and a jaw cylinder having a jaw device, which can cut a printed paper web, perform collect run in which a print paper sheet is wound around the folding cylinder and superposed and folded and straight run in which a print paper sheet is folded without being superposed, switch to either run type and discharge the print paper sheet subjected to collect run or straight run, the folding apparatus of a rotary press, comprising:

a fixed pin cam which is fixed on a frame side and can protrude/retract an end of a pin of each pin device with respect to an outer periphery of the folding cylinder once per rotation of the folding cylinder so as to perform an operation of straight run;

a correction pin cam which is provided being adjacent to the fixed pin cam so as to be capable of rotating around a shaft center of the folding cylinder with a number of revolutions different from that of the folding cylinder, can stop so as not to prevent an operation of the pin of each pin device protruded/retracted by the fixed pin cam in case of straight run, and protrude/retract an end portion of the pin of each pin device with respect to the outer periphery of the folding cylinder once per two rotations of the folding cylinder so as to perform an operation of collect run by an interaction with the fixed pin cam in case of collect run;

a blade cam which is provided adjacent to the correction pin cam and integral with correction pin cam so as to be capable of integrally rotating around the shaft center of the folding cylinder with the correction pin cam and actuating a blade of the blade device correlatively with an operation of the pin at a position opposed to the jaw device, can stop with the correction pin cam and thrust a blade of each blade device into the jaw device once per rotation of the folding cylinder so as to perform an operation of straight run in case of straight run, and rotate with the correction pin cam and thrust the blade of each blade device into the jaw device once per two rotations of the folding cylinder so as to perform an operation of collect run in case of collect run; and a switching device consisting of switching means in which a clutch member that is movable in a clutch shaft direction between a drive side and a stop side both of which are provided to face each other in the clutch shaft direction, and comprises convex portions on both sides of a moving direction is provided with a distance between tips of the convex portions on the both sides slightly larger than a distance between end faces on the drive side and the stop side so that switching between a drive side connection, that drives the two cams to rotate in connection with the drive side, and a stop side connection, that cancels the connection with the drive side and stops the two cams in a predetermined rotation phase, can be performed in a force transmission path through which a rotation drive is transmitted to the correction pin cam and the blade cam at the same time, and both of the drive side connection and the stop side connection can be instantaneously achieved at the time of the switching; and detecting means for detecting a start-up timing of the switching means according to a rotation of a drive source with either collect run or straight run being specified, wherein either collect run or straight run can be selectively switched while actuating the folding apparatus, and the clutch member relatively rotates while coming into contact with the end face on the drive side or the stop side and comes into engaging with a concave portion on the drive side or the stop side.

2. The folding apparatus of a rotary press according to claim 1, wherein the switching means comprises:

an intermediate shaft rotatably provided parallel with a shaft center of the cutting cylinder;

a driven gear which is meshed with a gear provided to the cutting cylinder on the drive side, provided so as to be capable of rotating around the intermediate shaft, and has a concave portion on a side surface thereof;

an intermediate shaft gear which is fixed to an end of the intermediate shaft and meshed with a relay gear between the correction pin cam and the blade cam on a driven side;

a fixing member which is arranged between the intermediate shaft gear and the driven gear, and has a concave portion opposed to a concave portion of the driven gear and a hole through which the intermediate shaft is inserted;

a clutch member which is provided between the driven gear and the fixing member, can move in an axial direction of the intermediate shaft and rotate integrally with the intermediate shaft in a rotational direction, has convex portions which can be fitted in the concave portion of the driven gear or the fixing member opposed to an end surface thereof in the axial direction being provided on both end surfaces in the axial direction, and has a dimension from a protruding end of the convex portion on one end surface to a protruding end of the convex portion on the other end surface being slightly larger than a distance between opposed end surfaces of the driven gear and the fixing member; and a movement mechanism which selectively moves the clutch member in either axial direction of the intermediate shaft.

3. The folding apparatus of a rotary press according to claim 2, wherein the clutch member can integrally rotate with the intermediate shaft by a key and can move with respect to intermediate shaft in the axial direction.

4. The folding apparatus of a rotary press according to claim 3, wherein the convex portions provided on the both end surfaces of the clutch member in the axial direction are provided in the form of a straight line in a direction perpendicularly cutting across a shaft center of the intermediate shaft in phase, and can be fitted in and connected with the concave portion of the driven gear or the concave portion of the fixing member when the clutch member completes movement on the intermediate shaft in the axial direction.

5. The folding apparatus of a rotary press according to claim 4, wherein the clutch member can also be connected with the fixing member at a position obtained by rotating the disconnected clutch member 180 degrees from the other connection position.

6. The folding apparatus of a rotary press according to claim 5, wherein the clutch member has a groove on an outer peripheral portion and is connected with the movement mechanism through the groove.

7. The folding apparatus of a rotary press according to claim 6, wherein the movement mechanism includes: a shift lever having a guide roller inserted into the groove at one end thereof, and fixed to a rotatable shaft; an operation lever fixed to the shaft; and a pneumatic cylinder connected to the other end of the operation lever.

8. The folding apparatus of a rotary press according to claim 7, wherein a cylinder rod of the pneumatic cylinder is connected to the other end of the operation lever, the shift lever is subjected to angular displacement by expansion or retraction of the cylinder rod of the pneumatic cylinder, and the clutch member can be moved in the axial direction of the intermediate shaft.

9. The folding apparatus of a rotary press according to claim 8, wherein the intermediate shaft rotates and enters a drive side connection state capable of transmitting a force when one convex portion of the clutch member is connected with the concave portion of the driven gear, and the intermediate shaft stops and enters a stop side connection state when the other convex portion of the clutch member is connected with the concave portion of the fixing member.

10. The folding apparatus of a rotary press according to claim 2, wherein the detecting means consists of a detection piece provided to a cutting cylinder shaft of the cutting cylinder, and a detector which detects the detection piece.

11. A folding apparatus of a rotary press, which includes: a cutting cylinder having at least one cutting blade device; a folding cylinder having at least one pin device and at least one blade device; and a jaw cylinder having a jaw device, which can cut a printed paper web, perform collect run in which a print paper sheet is wound around the folding cylinder and superposed and folded and straight run in which a print paper sheet is folded without being superposed, switch to either run type and discharge the print paper sheet subjected to collect run or straight run, the folding apparatus of a rotary press, comprising:

a fixed pin cam which is fixed on a frame side and can protrude/retract an end of a pin of each pin device with respect to an outer periphery of the folding cylinder once per rotation of the folding cylinder so as to perform an operation of straight run;

a correction pin cam which is provided being adjacent to the fixed pin cam so as to be capable of rotating around a shaft center of the folding cylinder with a number of revolutions different from that of the folding cylinder, can stop so as not to prevent an operation of the pin of each pin device protruded/retracted by the fixed pin cam in case of straight run, and protrude/retract an end portion of the pin of each pin device with respect to the outer periphery of the folding cylinder once per two rotations of the folding cylinder so as to perform an operation of collect run by an interaction with the fixed pin cam in case of collect run;

a blade cam which is provided adjacent to the correction pin cam so as to be capable of integrally rotating around the shaft center of the folding cylinder with the correction pin cam and actuating a blade of the blade device correlatively with an operation of the pin at a position opposed to the jaw device, can stop with the correction pin cam and thrust a blade of each blade device into the jaw device once per rotation of the folding cylinder so as to perform an operation of straight run in case of straight run, and rotate with the correction pin cam and thrust the blade of each blade device into the jaw device once per two rotations of the folding cylinder so as to perform an operation of collect run in case of collect run; and a switching device consisting of switching means which can switch between a drive side connection that drives the correction pin cam and the blade cam to rotate in connection with a drive side, and a stop side connection that cancels the connection with the drive side and stops the correction pin cam and the blade cam in a predetermined rotation phase in a force transmission path through which a rotation drive is transmitted to the correction pin cam and the blade cam at the same time, and which can instantaneously achieve both of the drive side connection and the stop side connection at the time of switching, and detecting means for detecting a start-up timing of the switching means according to a rotation of a drive source with either collect run or straight run being specified, wherein either collect run or straight run is selectively switched while actuating the folding apparatus, wherein the switching means comprises:

an intermediate shaft rotatably provided parallel with a shaft center of the cutting cylinder;

a driven gear which is meshed with a gear provided to the cutting cylinder on the drive side, provided so as to be capable of rotating around the intermediate shaft, and has a concave portion on a side surface thereof;

an intermediate shaft gear which is fixed to an end of the intermediate shaft and meshed with a relay gear between the correction pin cam and the blade cam on a driven side;

a fixing member which is arranged between the intermediate shaft gear and the driven gear, and has a concave portion opposed to a concave portion of the driven gear and a hole through which the intermediate shaft is inserted;

a clutch member which is provided between the driven gear and the fixing member, can move in an axial direction of the intermediate shaft and rotate integrally with the intermediate shaft in a rotational direction, has convex portions which can be fitted in the concave portion of the driven gear or the fixing member opposed to an end surface thereof in the axial direction being provided on both end surfaces in the axial direction, and has a dimension from a protruding end of the convex portion on one end surface to a protruding end of the convex portion on the other end surface being slightly larger than a distance between opposed end surfaces of the driven gear and the fixing member; and a movement mechanism which selectively moves the clutch member in either axial direction of the intermediate shaft.

12. The folding apparatus of a rotary press according to claim 11, wherein the clutch member can integrally rotate with the intermediate shaft by a key and can move with respect to the intermediate shaft in the axial direction.

13. The folding apparatus of a rotary press according to claim 12, wherein the convex portions provided on the both end surfaces of the clutch member in the axial direction are provided in the form of a straight line in a direction perpendicularly cutting across a shaft center of the intermediate shaft in phase, and can be fitted in and connected with the concave portion of the driven gear or the concave portion of the fixing member when the clutch member completes movement on the intermediate shaft in the axial direction.

14. The folding apparatus of a rotary press according to claim 13, wherein the clutch member can also be connected with the fixing member at a position obtained by rotating the disconnected clutch member 180 degrees from the other connection position.

15. The folding apparatus of a rotary press according to claim 14, wherein the clutch member has a groove on an outer peripheral portion and is connected with the movement mechanism through the groove.

16. The folding apparatus of a rotary press according to claim 15, wherein the movement mechanism includes: a shift lever having a guide roller inserted into the groove at one end thereof, and fixed to a rotatable shaft; an operation lever fixed to the shaft; and a pneumatic cylinder connected to the other end of the operation lever.

17. The folding apparatus of a rotary press according to claim 16, wherein a cylinder rod of the pneumatic cylinder is connected to the other end of the operation lever, the shift lever is subjected to angular displacement by expansion or retraction of the cylinder rod of the pneumatic cylinder, and the clutch member can be moved in the axial direction of the intermediate shaft.

18. The folding apparatus of a rotary press according to claim 17, wherein the intermediate shaft rotates and enters a drive side connection state capable of transmitting a force when one convex portion of the clutch member is connected with the concave portion of the driven gear, and the intermediate shaft stops and enters a stop side connection state when the other convex portion of the clutch member is connected with the concave portion of the fixing member.

19. The folding apparatus of a rotary press according to claim 11, wherein the detecting means consists of a detection piece provided to a cutting cylinder shaft of the cutting cylinder, and a detector which detects the detection piece.

* * * * *